US009717955B2

(12) United States Patent
Isogawa et al.

(10) Patent No.: US 9,717,955 B2
(45) Date of Patent: Aug. 1, 2017

(54) GOLF BALL

(75) Inventors: Kazuhiko Isogawa, Kobe (JP); Hirotaka Nakamura, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 572 days.

(21) Appl. No.: 13/096,654

(22) Filed: Apr. 28, 2011

(65) Prior Publication Data

US 2011/0319193 A1 Dec. 29, 2011

(30) Foreign Application Priority Data

Jun. 29, 2010 (JP) ..... 2010-147123

(51) Int. Cl.
*A63B 37/04* (2006.01)
*A63B 37/00* (2006.01)

(52) U.S. Cl.
CPC ..... *A63B 37/0031* (2013.01); *A63B 37/0033* (2013.01); *A63B 37/0043* (2013.01); *A63B 37/0045* (2013.01); *A63B 37/0047* (2013.01); *A63B 37/0062* (2013.01); *A63B 37/0066* (2013.01); *A63B 37/0075* (2013.01)

(58) Field of Classification Search
USPC ..... 473/373, 385, 374, 377, 351
See application file for complete search history.

(56) References Cited

U.S. PATENT DOCUMENTS 4,069,259 A * 1/1978 Cipris et al. ..... 568/24
4,413,098 A * 11/1983 Hattori et al. ..... 525/314
4,570,937 A * 2/1986 Yamada ..... A63B 37/0003 473/372
5,072,944 A 12/1991 Nakahara et al.
5,184,828 A * 2/1993 Kim ..... A63B 37/0003 473/373
5,403,010 A 4/1995 Yabuki et al.
(Continued)

FOREIGN PATENT DOCUMENTS

JP 2010-22504 A 2/2010

OTHER PUBLICATIONS

Dupont, Hardness conversion, Jul. 31, 2013, Dupont, 1 page.*
(Continued)

*Primary Examiner* — Gene Kim
*Assistant Examiner* — Matthew B Stanczak
(74) *Attorney, Agent, or Firm* — Birch, Stewart, Kolasch & Birch, LLP

(57) ABSTRACT

A golf ball 2 includes a spherical core 4, a mid layer 6, and a cover 8. The core 4 is obtained by crosslinking a rubber composition. The difference between: a hardness H(5.0) at a point which is located at a distance of 5 mm from the central point of the core 4; and a hardness Ho at the central point is 6.0 or greater. The difference between: a hardness H(12.5) at a point which is located at a distance of 12.5 mm from the central point; and the hardness H(5.0) is 4.0 or less. The difference between a hardness Hs at the surface of the core 4 and the hardness H(12.5) is 10.0 or greater. The difference between the hardness Hs and the hardness Ho is 22.0 or greater. There is no zone in which a hardness decreases from the central point to the surface. A Shore D hardness H3 of the cover is greater than a Shore D hardness H2 of the mid layer.

14 Claims, 18 Drawing Sheets

(56) References Cited

U.S. PATENT DOCUMENTS

| | | | | |
|---|---|---|---|---|
| 5,490,673 | A * | 2/1996 | Hiraoka | A63B 37/0003 473/372 |
| 5,516,110 | A | 5/1996 | Yabuki et al. | |
| 5,562,287 | A | 10/1996 | Endo et al. | |
| 5,645,496 | A * | 7/1997 | Endo | A63B 37/0003 473/351 |
| 6,129,640 | A | 10/2000 | Higuchi et al. | |
| 6,386,993 | B1 * | 5/2002 | Yokota | A63B 37/0003 473/373 |
| 6,632,149 | B2 * | 10/2003 | Yoshida | A63B 37/0003 473/351 |
| 6,716,115 | B2 * | 4/2004 | Isogawa | A63B 37/0003 473/351 |
| 6,815,507 | B2 * | 11/2004 | Ohama | A63B 37/0003 473/371 |
| 6,919,393 | B2 * | 7/2005 | Mano | A63B 37/0003 473/371 |
| 7,410,429 | B1 * | 8/2008 | Bulpett | A63B 37/0051 473/376 |
| 7,429,221 | B1 * | 9/2008 | Bulpett | A63B 37/0003 473/376 |
| 8,043,168 | B2 * | 10/2011 | Isogawa | A63B 37/0003 473/373 |
| 8,313,394 | B2 * | 11/2012 | Sullivan | A63B 37/0062 473/373 |
| 8,313,395 | B2 * | 11/2012 | Sullivan | A63B 37/0062 473/373 |
| 8,398,507 | B2 * | 3/2013 | Sullivan | A63B 37/0003 473/371 |
| 8,414,426 | B2 * | 4/2013 | Sullivan | A63B 37/0063 473/373 |
| 2002/0019269 | A1 | 2/2002 | Watanabe | |
| 2002/0032077 | A1 | 3/2002 | Watanabe | |
| 2003/0032501 | A1 | 2/2003 | Sakagami et al. | |
| 2003/0045377 | A1 * | 3/2003 | Masutani | A63B 37/0003 473/377 |
| 2006/0178231 | A1 * | 8/2006 | Kasashima | A63B 37/0004 473/371 |
| 2008/0194357 | A1 | 8/2008 | Higuchi | |
| 2008/0312008 | A1 | 12/2008 | Higuchi et al. | |
| 2009/0011857 | A1 * | 1/2009 | Bulpett | A63B 37/0062 473/373 |
| 2009/0011862 | A1 * | 1/2009 | Bulpett | A63B 37/0063 473/376 |
| 2009/0011866 | A1 * | 1/2009 | Sullivan | A63B 37/0003 473/377 |
| 2009/0011867 | A1 * | 1/2009 | Sullivan | A63B 37/0044 473/377 |
| 2009/0312121 | A1 | 12/2009 | Isogawa et al. | |
| 2010/0069175 | A1 * | 3/2010 | Kamino | A63B 37/0003 473/376 |
| 2010/0323819 | A1 * | 12/2010 | Comeau | A63B 37/0003 473/376 |
| 2011/0053709 | A1 * | 3/2011 | Comeau | A63B 37/0003 473/376 |
| 2012/0172151 | A1 * | 7/2012 | Mikura | A63B 37/0062 473/372 |

OTHER PUBLICATIONS www.chemicalbook.com, Diphenyl Disulfide, Nov. 22, 2013, Chemical Book, 2 pages.*

Dupont, Hardness Conversion, Nov. 22, 2013, 1 page.* webbook.nist.gov (National Institute of Standards and Technology), 2-Naphthalenethiol, Nov. 21, 2013, 2 pages.*

Thermal Tech Equipment, Shore Durometer Conversion Chart, uploaded Oct. 21, 2015, Thermal Tech Equipment, 1 page.*

Dupont, Hardness Conversion, uploaded Oct. 21, 2015, Dupont, 1 page.*

Examiner's Calculations, uploaded Oct. 21, 2015, Excel Spreadsheet, 1 page.*

* cited by examiner

GOLF BALL

This application claims priority on Patent Application No. 2010-147123 filed in JAPAN on Jun. 29, 2010. The entire contents of this Japanese Patent Application are hereby incorporated by reference.

BACKGROUND OF THE INVENTION

Field of the Invention

The present invention relates to golf balls. Specifically, the present invention relates to golf balls including a solid core, a mid layer and a cover.

Description of the Related Art

Golf players' foremost requirement for golf balls is flight performance. Golf players place importance on flight performance upon shots with a driver, a long iron, and a middle iron. Flight performance correlates with the resilience performance of a golf ball. When a golf ball with excellent resilience performance is hit, the golf ball flies at a high speed, thereby achieving a large flight distance.

An appropriate trajectory height is required in order to achieve a large flight distance. A trajectory height depends on a spin rate and a launch angle. In a golf ball which achieves a high trajectory by a high spin rate, a flight distance is insufficient. In a golf ball which achieves a high trajectory by a high launch angle, a large flight distance is obtained. By using a golf ball having an outer-hard/inner-soft structure, a low spin rate and a high launch angle can be achieved.

JPH2-264674 (U.S. Pat. No. 5,072,944) discloses a golf ball with a core consisting of a center and an outer layer. The center is flexible, and the outer layer is hard. The core suppresses a spin rate.

However, in the golf ball disclosed in JPH2-264674, the structure of the core is complicated. The core produces an energy loss when being hit. In addition, the core has inferior durability.

JPH6-98949 (U.S. Pat. No. 5,516,110) discloses a golf ball having a constant hardness between: a point which is located at a distant of 5 mm from a central point; and a point which is located at a distant of 10 mm from the central point. A similar golf ball is also disclosed in JPH6-154357 (U.S. Pat. No. 5,403,010).

However, in the golf ball disclosed in JPH6-98949, a range where the hardness is constant is narrow. The golf ball has inferior resilience performance. Similarly, the golf ball disclosed in JPH6-154357 also has inferior resilience performance.

JPH7-112036 (U.S. Pat. No. 5,562,287) discloses a golf ball having a small difference between a central hardness and a surface hardness of a core. This core contributes to the resilience performance of the golf ball.

However, in the golf ball disclosed in JPH7-112036, a spin rate is excessive. The golf ball has a small flight distance.

JPH11-253578 (U.S. Pat. No. 6,129,640) discloses a golf ball having a core, a mid layer having a specific gravity greater than a specific gravity of the core, and a cover having a hardness smaller than a hardness of the mid layer.

However, in the golf ball disclosed in JPH11-253578, a resilience performance is deteriorated by the mid layer. The golf ball has a small flight distance.

JP2002-764 (US2002/032077) discloses a golf ball having a great difference between a central hardness and a surface hardness of a core. A similar golf ball is also disclosed in JP2002-765 (US2002/019269).

However, the golf ball disclosed in JP2002-764 has inferior resilience performance. Similarly, the golf ball disclosed in JP2002-765 also has inferior resilience performance.

JP2003-33447 (US2003/032501) discloses a golf ball with a core for which a rubber composition includes a polysulfide. The polysulfide contributes to the resilience performance of the golf ball.

However, in the golf ball disclosed in JP2003-33447, a spin rate is excessive. The golf ball has inferior flight performance.

JP2008-194473 (US2008/194357 and US2008/312008) discloses a golf ball having a great difference between a central hardness and a surface hardness of a core. A similar golf ball is also disclosed in JP2010-22504.

However, in the golf ball disclosed in JP2008-194473, there is a zone in which a hardness decreases from the central point of the core toward the surface of the core. The golf ball has inferior resilience performance. In the golf ball, a spin rate is excessive. The golf ball has inferior flight performance. Similarly, the golf ball disclosed in JP2010-22504 also has inferior flight performance.

JP2009-297261 (US2009/312121) discloses a golf ball having a center, a mid layer having a hardness smaller than a surface hardness of the center, and a cover having a weight smaller than a weight of the mid layer.

However, in the golf ball disclosed in JP2009-297261, a difference between a surface hardness and a central hardness of the core is not great. In the golf ball, a spin rate is excessive. The golf ball has inferior flight performance.

An object of the present invention is to provide a golf ball having excellent flight performance.

SUMMARY OF THE INVENTION

A golf ball according to the present invention comprises a core, a mid layer positioned outside the core, and a cover positioned outside the mid layer. A difference between: a JIS-C hardness H(5.0) at a point which is located at a distance of mm from a central point of the core; and a JIS-C hardness Ho at the central point is equal to or greater than 6.0. A difference between: a JIS-C hardness H(12.5) at a point which is located at a distance of 12.5 mm from the central point; and the hardness H(5.0) is equal to or less than 4.0. A difference between a JIS-C hardness Hs at a surface of the core and the hardness H(12.5) is equal to or greater than 10.0. A difference between the hardness Hs and the hardness Ho is equal to or greater than 22.0. In this golf ball, there is no zone in which a hardness decreases from the central point toward the surface. The mid layer is constituted with a resin composition. The base polymer of the resin composition includes an ionomer resin as a principal component. A Shore D hardness H3 of the cover is greater than a Shore D hardness H2 of the mid layer. Preferably, a specific gravity SG2 of the mid layer is greater than a specific gravity SG1 of the core.

The core may be formed by crosslinking a rubber composition including a base rubber and an organic sulfur compound. Preferably, the organic sulfur compound has a molecular weight of 150 or higher but 200 or lower and a melting point of 65° C. or higher but 90° C. or lower. Preferably, the rubber composition includes the base rubber in an amount of 100 parts by weight, and the organic sulfur compound in an amount which is equal to or greater than 0.05 parts by weight but equal to or less than 3.0 parts by weight. Preferably, the organic sulfur compound is 2-naphthalenethiol.

Preferably, the hardness Ho is equal to or greater than 40.0 but equal to or less than 70.0, and the hardness Hs is equal to or greater than 78.0 but equal to or less than 95.0.

Preferably, a thickness of the mid layer is equal to or greater than 0.5 mm but equal to or less than 1.2 mm, and a thickness of the cover is equal to or greater than 0.3 mm but equal to or less than 1.3 mm. Preferably, a sum (W2+W3) of a weight W2 of the mid layer and a weight W3 of the cover is 8.4 g or greater but 12.0 g or less. Preferably, a sum (V2+V3) of a volume V2 of the mid layer and a volume V3 of the cover is equal to or less than 10 $cm^3$. Preferably, the specific gravity SG2 of the mid layer is equal to or greater than 1.15.

Preferably, the cover is constituted with resin composition. Preferably, the base polymer of the resin composition includes an ionomer resin as a principal component.

Preferably, the hardness H(5.0) is equal to or greater than 62.0 but equal to or less than 72.0.

Preferably, the hardness H(12.5) is equal to or greater than 63.0 but equal to or less than 73.0.

Preferably, a difference (SG2−SG1) between the specific gravity SG2 of the mid layer and the specific gravity SG1 of the core is equal to or greater than 0.05 but equal to or less than 0.4.

Preferably, the hardness H2 is equal to or greater than 35 but equal to or less than 57.

Preferably, the hardness H3 is equal to or greater than 57 but equal to or less than 66.

Preferably, a difference (H3−H2) between the hardness H3 and the hardness H2 is equal to or greater than 4 but equal to or less than 20.

In the golf ball according to the present invention, a hardness distribution is appropriate. The golf ball has a low energy loss when being hit. The golf ball has excellent resilience performance. When the golf ball is hit with a driver, a spin rate is low. The great resilience performance and the low spin rate achieve a large flight distance.

DESCRIPTION OF THE PREFERRED EMBODIMENTS

The following will describe in detail the present invention based on preferred embodiments with reference to the accompanying drawings.

Figure 1:
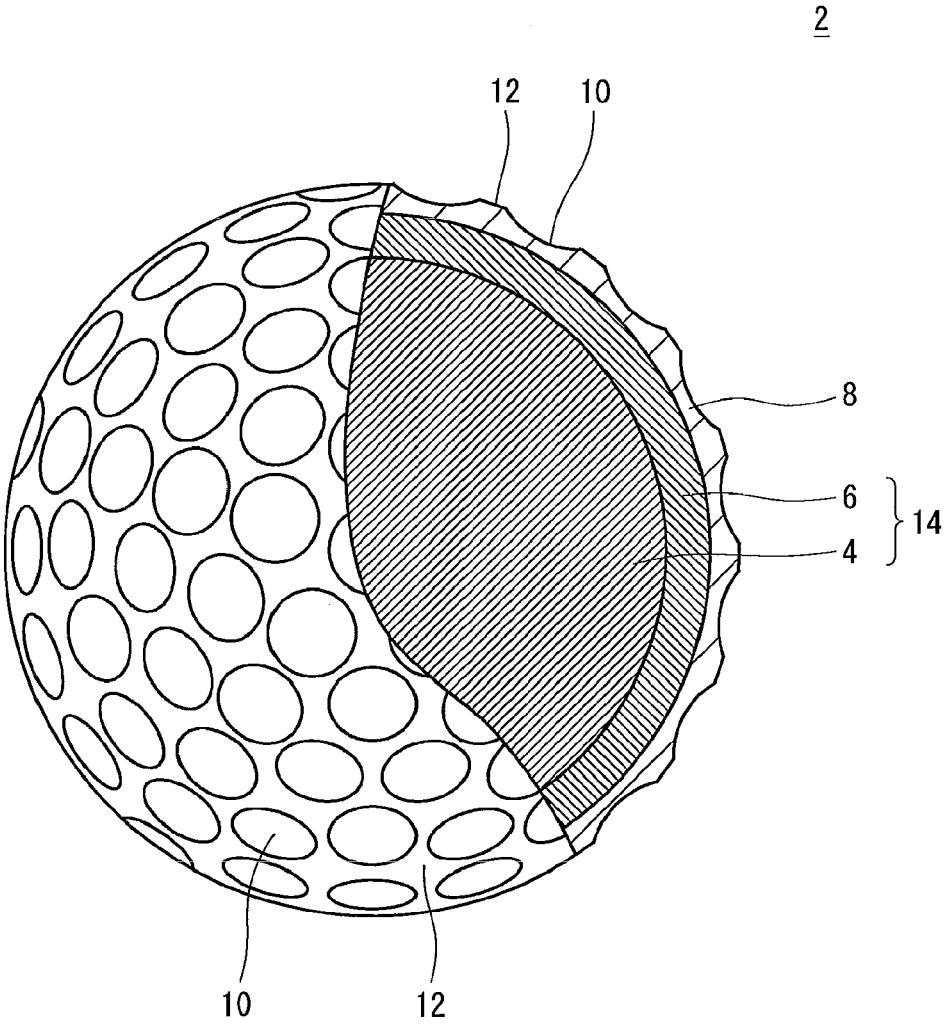
FIG. 1 is a partially cutaway cross-sectional view of a golf ball according to one embodiment of the present invention.

A golf ball 2 shown in FIG. 1 includes a spherical core 4, a mid layer 6 positioned outside the core 4, and a cover 8 positioned outside the mid layer 6. On the surface of the cover 8, a large number of dimples 10 are formed. Of the surface of the golf ball 2, a part other than the dimples 10 is a land 12. The golf ball 2 includes a paint layer and a mark layer on the external side of the cover 8 although these layers are not shown in the drawing.

The golf ball 2 has a diameter of 40 mm or greater but 45 mm or less. From the standpoint of conformity to the rules established by the United States Golf Association (USGA), the diameter is preferably equal to or greater than 42.67 mm. In light of suppression of air resistance, the diameter is preferably equal to or less than 44 mm and more preferably equal to or less than 42.80 mm. The golf ball 2 has a weight of 40 g or greater but 50 g or less. In light of attainment of great inertia, the weight is preferably equal to or greater than 44 g and more preferably equal to or greater than 45.00 g. From the standpoint of conformity to the rules established by the USGA, the weight is preferably equal to or less than 45.93 g.

In the present invention, a JIS-C hardness at a point which is located at a distance of x (mm) from the central point of the core 4 is indicated by H(x). In the present invention, a hardness at the central point of the core 4 is indicated by Ho, and a surface hardness of the core 4 is indicated by Hs.

The hardness Ho and the hardness H(x) are measured by pressing a JIS-C type hardness scale against a cut plane of the core 4 which has been cut into two halves. For the measurement, an automated rubber hardness measurement machine (trade name "P1", manufactured by Kobunshi Keiki Co., Ltd.), to which this hardness scale is mounted, is used. The surface hardness Hs is measured by pressing a JIS-C type hardness scale against the surface of the core 4. For the measurement, an automated rubber hardness measurement machine (trade name "P1", manufactured by Kobunshi Keiki Co., Ltd.), to which this hardness scale is mounted, is used.

Figure 2:
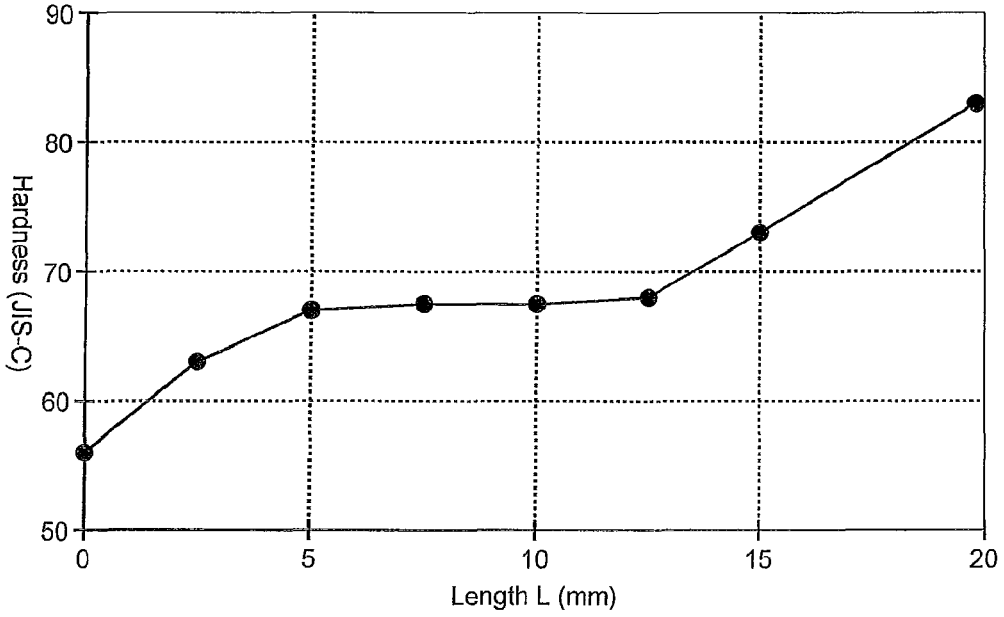
FIG. 2 is a graph showing a hardness distribution of a core of the golf ball in FIG. 1.

FIG. 2 shows a hardness distribution of the core 4. In this embodiment, the core 4 has a diameter of 39.6 mm. Thus, in FIG. 2, a hardness at a point which is located at a distance of 19.8 mm from the central point is the hardness Hs at the surface. As is obvious from FIG. 2, in the core 4, there is no zone in which the hardness decreases from the central point toward the surface. The core 4 has an outer-hard/inner-soft structure. The core 4 has a low energy loss when being hit. The core 4 has excellent resilience performance. In the core 4, spin is suppressed. The core 4 contributes to the flight performance of the golf ball 2.

As shown in FIG. 2, in this embodiment, a hardness H(5.0) is 67.0, and the hardness Ho is 56.0. A difference (H(5.0)−Ho) between the hardness H(5.0) and the hardness Ho is 11.0. The difference (H(5.0)−Ho) is great. In the golf ball 2 in which the difference (H(5.0)−Ho) is great, a spin rate is low when the golf ball 2 is hit with a driver. The low spin rate can achieve a large flight distance. In light of suppression of spin, the difference (H(5.0)−Ho) is preferably equal to or greater than 6.0 and particularly preferably equal to or greater than 8.0. In light of ease of producing the core 4, a difference (H(5.0)−Ho) is preferably equal to or less than 15.0.

As shown in FIG. 2, in this embodiment, a hardness H(12.5) is 68.0, and the hardness H(5.0) is 67.0. The difference (H(12.5)−H(5.0)) between the hardness H(12.5) and the hardness H(5.0) is 1.0. The difference (H(12.5)−H(5.0)) is small. In the core 4, the hardness distribution curve is almost flat between: a point which is located at a distance of 5.0 mm from the central point; and a point which is located at a distance of 12.5 mm from the central point. In the golf ball 2 in which the difference (H(12.5)−H(5.0)) is small, an energy loss is low when the golf ball 2 is hit with the driver. The golf ball 2 has excellent resilience performance. In light of resilience performance, the difference (H(12.5)−H(5.0)) is preferably equal to or greater than 0.0 but equal to or less than 4.0, more preferably equal to or greater than 0.5 but equal to or less than 3.0, and particularly preferably equal to or greater than 0.5 but equal to or less than 1.5.

As shown in FIG. 2, in this embodiment, the hardness Hs is 83.0, and the hardness H(12.5) is 68.0. A difference (Hs−H(12.5)) between the hardness Hs and the hardness H(12.5) is 15.0. The difference (Hs−H(12.5)) is great. In the golf ball 2 in which the difference (Hs−H(12.5)) is great, a spin rate is low when the golf ball 2 is hit with the driver. The low spin rate can achieve a large flight distance. In light of suppression of spin, the difference (Hs−H(12.5)) is preferably equal or greater than 10.0, more preferably equal to or greater than 13.0, and particularly preferably equal to or greater than 14.0. In light of ease of producing the core 4, the difference (Hs−H(12.5)) is preferably equal to or less than 20.0.

As described above, in this embodiment, the hardness Ho is 56.0, and the hardness Hs is 83.0. The difference (Hs−Ho) between the hardness Hs and the hardness Ho is 27.0. A difference (Hs−Ho) is great. In the golf ball 2 in which the difference (Hs−Ho) is great, a spin rate is low when the golf ball 2 is hit with the driver. The low spin rate can achieve a large flight distance. In light of suppression of spin, the difference (Hs−Ho) is preferably equal to or greater than 22.0 and particularly preferably equal to or greater than 24.0. In light of ease of producing the core 4, the difference (Hs−Ho) is preferably equal to or less than 35.0.

The hardness Ho at the central point is preferably equal to or greater than 40.0 but equal to or less than 70.0. The golf ball 2 in which the hardness Ho is equal to or greater than 40.0 has excellent resilience performance. In this respect, the hardness Ho is more preferably equal to or greater than 45.0 and particularly preferably equal to or greater than 50.0. The core 4 in which the hardness Ho is equal to or less than 70.0 can achieve the outer-hard/inner-soft structure. In the golf ball 2 with this core 4, spin can be suppressed. In this respect, the hardness Ho is more preferably equal to or less than 66.0 and particularly preferably equal to or less than 64.0.

The hardness H(5.0) is preferably equal to or greater than 62.0 but equal to or less than 72.0. The golf ball 2 in which the hardness H(5.0) is equal to or greater than 62.0 has excellent resilience performance. In this respect, the hardness H(5.0) is particularly preferably equal to or greater than 64.0. The golf ball 2 in which the hardness H(5.0) is equal to or less than 72.0 provides excellent feel at impact. In this respect, the hardness H(5.0) is particularly preferably equal to or less than 70.0.

The hardness H(12.5) is preferably equal to or greater than 63.0 but equal to or less than 73.0. The golf ball 2 in which the hardness H(12.5) is equal to or greater than 63.0 has excellent resilience performance. In this respect, the hardness H(12.5) is particularly preferably equal to or greater than 65.0. The golf ball 2 in which the hardness H(12.5) is equal to or less than 73.0 provides excellent feel at impact. In this respect, the hardness H(12.5) is particularly preferably equal to or less than 71.0.

The hardness Hs at the surface of the core 4 is preferably equal to or greater than 78.0 but equal to or less than 95.0. The core 4 in which the hardness Hs is equal to or greater than 78.0 can achieve the outer-hard/inner-soft structure. In the golf ball 2 with this core 4, spin can be suppressed. In this respect, the hardness Hs is more preferably equal to or greater than 80.0 and particularly preferably equal to or greater than 82.0. The golf ball 2 in which the hardness Hs is equal to or less than 95.0 has excellent durability. In this respect, the hardness Hs is more preferably equal to or less than 93.0 and particularly preferably equal to or less than 88.0.

The core 4 is obtained by crosslinking a rubber composition. Examples of base rubbers for use in the rubber composition of the core 4 include polybutadienes, polyisoprenes, styrene-butadiene copolymers, ethylene-propylene-diene copolymers, and natural rubbers. In light of resilience performance, polybutadienes are preferred. When a polybutadiene and another rubber are used in combination, it is preferred if the polybutadiene is included as a principal component. Specifically, the proportion of the polybutadiene to the entire base rubber is preferably equal to or greater than 50% by weight and more preferably equal to or greater than 80% by weight. The proportion of cis-1,4 bonds in the polybutadiene is preferably equal to or greater than 40% and more preferably equal to or greater than 80%.

The rubber composition of the core 4 includes a co-crosslinking agent. The co-crosslinking agent achieves high resilience of the core 4. Examples of preferable co-crosslinking agents in light of resilience performance include monovalent or bivalent metal salts of an α,β-unsaturated carboxylic acid having 2 to 8 carbon atoms. Specific examples of preferable co-crosslinking agents include zinc acrylate, magnesium acrylate, zinc methacrylate, and magnesium methacrylate. In light of resilience performance, zinc acrylate and zinc methacrylate are particularly preferred.

In light of resilience performance of the golf ball 2, the amount of the co-crosslinking agent is preferably equal to or greater than 15 parts by weight, and more preferably equal to or greater than 25 parts by weight, per 100 parts by weight of the base rubber. In light of soft feel at impact, the amount of the co-crosslinking agent is preferably equal to or less than 50 parts by weight, and particularly preferably equal to or less than 45 parts by weight, per 100 parts by weight of the base rubber.

Preferably, the rubber composition of the core 4 includes an organic peroxide. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy) hexane, and di-t-butyl peroxide. In light of versatility, dicumyl peroxide is preferred.

In light of resilience performance of the golf ball 2, the amount of the organic peroxide is preferably equal to or greater than 0.1 parts by weight, more preferably equal to or greater than 0.2 parts by weight, and particularly preferably equal to or greater than 0.3 parts by weight, per 100 parts by weight of the base rubber. In light of soft feel at impact, the amount of the organic peroxide is preferably equal to or less than 2.0 parts by weight, more preferably equal to or less than 1.5 parts by weight, and particularly preferably equal to or less than 1.0 parts by weight, per 100 parts by weight of the base rubber.

Preferably, the rubber composition of the core 4 includes an organic sulfur compound. In light of achievement of both excellent resilience performance and a low spin rate, the organic sulfur compound having a molecular weight of 150 or higher but 200 or lower is preferred. The molecular weight is particularly preferably equal to or higher than 155. The molecular weight is particularly preferably equal to or lower than 170.

In light of achievement of both excellent resilience performance and a low spin rate, the organic sulfur compound having a melting point of 65° C. or higher but 90° C. or lower. The melting point is particularly preferably equal to or higher than 75° C. The melting point is particularly preferably equal to or lower than 85° C.

The organic sulfur compounds include naphthalenethiol type compounds, benzenethiol type compounds, and disulfide type compounds.

Examples of naphthalenethiol type compounds includes
1-naphthalenethiol, 2-naphthalenethiol,
4-chloro-1-naphthalenethiol, 4-bromo-1-naphthalenethiol, 1-chloro-2-naphthalenethiol, 1-bromo-2-naphthalenethiol,
1-fluoro-2-naphthalenethiol, 1-cyano-2-naphthalenethiol, and
1-acetyl-2-naphthalenethiol.

Examples of benzenethiol type compounds include
benzenethiol, 4-chlorobenzenethiol, 3-chlorobenzenethiol,
4-bromobenzenethiol, 3-bromobenzenethiol,
4-fluorobenzenethiol, 4-iodobenzenethiol,
2,5-dichlorobenzenethiol, 3,5-dichlorobenzenethiol,
2,6-dichlorobenzenethiol, 2,5-dibromobenzenethiol,
3,5-dibromobenzenethiol, 2-chloro-5-bromobenzenethiol,
2,4,6-trichlorobenzenethiol,
2,3,4,5,6-pentachlorobenzenethiol,
2,3,4,5,6-pentafluorobenzenethiol, 4-cyanobenzenethiol,
2-cyanobenzenethiol, 4-nitrobenzenethiol, and
2-nitrobenzenethiol.

Examples of disulfide type compounds include diphenyl disulfide, bis(4-chlorophenyl)disulfide,
bis(3-chlorophenyl)disulfide, bis(4-bromophenyl)disulfide,
bis(3-bromophenyl)disulfide, bis(4-fluorophenyl)disulfide,
bis(4-iodophenyl)disulfide, bis(4-cyanophenyl)disulfide,
bis(2,5-dichlorophenyl)disulfide,
bis(3,5-dichlorophenyl)disulfide,
bis(2,6-dichlorophenyl)disulfide,
bis(2,5-dibromophenyl)disulfide,
bis(3,5-dibromophenyl)disulfide,
bis(2-chloro-5-bromophenyl)disulfide,
bis(2-cyano-5-bromophenyl)disulfide,
bis(2,4,6-trichlorophenyl)disulfide,
bis(2-cyano-4-chloro-6-bromophenyl)disulfide,
bis(2,3,5,6-tetrachlorophenyl)disulfide,
bis(2,3,4,5,6-pentachlorophenyl)disulfide, and
bis(2,3,4,5,6-pentabromophenyl)disulfide.

From the standpoint that the core 4 having an appropriate hardness distribution is obtained, particularly preferable organic sulfur compounds are 1-naphthalenethiol and 2-naphthalenethiol. The molecular weight of each of 1-naphthalenethiol and 2-naphthalenethiol is 160.2. The melting point of 2-naphthalenethiol is 79° C. to 81° C.

The most preferable organic sulfur compound is 2-naphthalenethiol. The chemical formula of 2-naphthalenethiol is shown below.

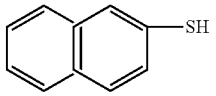

From the standpoint that the core 4 having the appropriate hardness distribution is obtained, the amount of the organic sulfur compound is preferably equal to or greater than 0.05 parts by weight, more preferably equal to or greater than 0.08 parts by weight, and particularly preferably equal to or greater than 0.10 parts by weight, per 100 parts by weight of the base rubber. In light of resilience performance, the amount of the organic sulfur compound is preferably equal to or less than 3.0 parts by weight, more preferably equal to or less than 2.0 parts by weight, and particularly preferably equal to or less than 1.0 parts by weight, per 100 parts by weight of the base rubber.

For the purpose of adjusting specific gravity and the like, a filler may be included in the core 4. Examples of suitable fillers include zinc oxide, barium sulfate, calcium carbonate, and magnesium carbonate. The amount of the filler is determined as appropriate so that the intended specific gravity of the core 4 is accomplished. A particularly preferable filler is zinc oxide. Zinc oxide serves not only as a specific gravity adjuster but also as a crosslinking activator.

According to need, an anti-aging agent, a coloring agent, a plasticizer, a dispersant, sulfur, an vulcanization accelerator, and the like are added to the rubber composition of the core 4. Crosslinked rubber powder or synthetic resin powder may be also dispersed in the rubber composition.

The core 4 has a diameter of preferably 38.0 mm or greater but 42.0 mm or less. The core 4 having a diameter of 38.0 mm or greater can achieve excellent resilience performance of the golf ball 2. The core 4 having a diameter of 38.0 mm or greater can achieve the outer-hard/inner-soft structure of the golf ball 2. In this respect, the diameter is more preferably equal to or greater than 39.0 mm and particularly preferably equal to or greater than 39.5 mm. In the golf ball 2 with the core 4 having a diameter of 42.0 mm or less, the mid layer 6 and the cover 8 can have a sufficient thickness. The golf ball 2 with the mid layer 6 and the cover 8 having a large thickness has excellent durability. In this respect, the diameter is more preferably equal to or less than 41 mm and particularly preferably equal to or less than 40 mm. The core 4 may have two or more layers.

A resin composition is suitably used for the mid layer 6. Examples of the base polymer of the resin composition include ionomer resins, styrene block-containing thermoplastic elastomers, thermoplastic polyester elastomers, thermoplastic polyamide elastomers, and thermoplastic polyolefin elastomers.

Particularly preferable base polymers are ionomer resins. The golf ball 2 with the mid layer 6 including an ionomer resin has excellent resilience performance. An ionomer resin and another resin may be used in combination for the mid layer 6. In this case, the principal component of the base polymer is preferably the ionomer resin. Specifically, the proportion of the ionomer resin to the entire base polymer is preferably equal to or greater than 50% by weight, more preferably equal to or greater than 60% by weight, and particularly preferably equal to or greater than 70% by weight.

Examples of preferable ionomer resins include binary copolymers formed with an α-olefin and an α,β-unsaturated carboxylic acid having 3 to 8 carbon atoms. A preferable binary copolymer includes 80% by weight or more and 90% by weight or less of an α-olefin, and 10% by weight or more and 20% by weight or less of an α,β-unsaturated carboxylic acid. The binary copolymer has excellent resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more and 85% by weight or less of an α-olefin, 5% by weight or more and 30% by weight or less of an α,β-unsaturated carboxylic acid, and 1% by weight or more and 25% by weight or less of an α,β-unsaturated carboxylate ester. The ternary copolymer has excellent resilience performance. For the binary copolymer and the ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid or methacrylic acid.

In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan AM7329", "Himilan MK7320", and "Himilan MK7329", manufactured by Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation.

Two or more types of ionomer resins may be used in combination for the mid layer 6. An ionomer resin neutralized with a monovalent metal ion, and an ionomer resin neutralized with a bivalent metal ion may be used in combination.

A preferable resin which can be used in combination with an ionomer resin is a styrene block-containing thermoplastic elastomer. The styrene block-containing thermoplastic elastomer has excellent compatibility with ionomer resins. A resin composition including the styrene block-containing thermoplastic elastomer has excellent fluidity.

The styrene block-containing thermoplastic elastomer includes a polystyrene block as a hard segment, and a soft segment. A typical soft segment is a diene block. Examples of diene compounds include butadiene, isoprene, 1,3-pentadiene, and 2,3-dimethyl-1,3-butadiene. Butadiene and isoprene are preferred. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the styrene block-containing thermoplastic elastomer is preferably equal to or greater than 10% by weight, more preferably equal to or greater than 12% by weight, and particularly preferably equal to or greater than 15% by weight. In light of feel at impact of the golf ball 2, the content is preferably equal to or less than 50% by weight, more preferably equal to or less than 47% by weight, and particularly preferably equal to or less than 45% by weight.

In the present invention, styrene block-containing thermoplastic elastomers include alloys of olefin and one or more types selected from the group consisting of SBS, SIS, SIBS, SEBS, SEPS, SEEPS, and hydrogenated products thereof. The olefin component in the alloy is presumed to contribute to improvement of compatibility with ionomer resins. Use of this alloy improves the resilience performance of the golf ball 2. An olefin having 2 to 10 carbon atoms is preferably used. Examples of suitable olefins include ethylene, propylene, butene, and pentene. Ethylene and propylene are particularly preferred.

Specific examples of polymer alloys include trade names "RabalonT3221C", "RabalonT3339C", "RabalonSJ4400N", "Rabalon SJ5400N", "Rabalon SJ6400N", "Rabalon SJ7400N", "Rabalon SJ8400N", "Rabalon SJ9400N", and "Rabalon SR04", manufactured by Mitsubishi Chemical Corporation. Other specific examples of styrene block-containing thermoplastic elastomers include trade name "Epofriend A1010" manufactured by Daicel Chemical Industries, Ltd., and trade name "Septon HG-252" manufactured by Kuraray Co., Ltd.

According to need, a coloring agent such as titanium dioxide, a filler such as barium sulfate, a dispersant, an antioxidant, an ultraviolet absorber, a light stabilizer, a fluorescent material, a fluorescent brightener, and the like are added to the resin composition of the mid layer 6 in an adequate amount.

Preferably, the mid layer 6 includes a powder of highly dense metal. The mid layer 6 has a great specific gravity. A specific gravity SG2 of the mid layer 6 is greater than a specific gravity SG1 of the core 4. The mid layer 6 and the core 4 can achieve an outer-heavy/inner-light structure of the golf ball 2. In the golf ball having the outer-heavy/inner-light structure, back spin is suppressed. Large flight distance can be obtained by the golf ball 2. In the golf ball having the outer-heavy/inner-light structure, side spin is suppressed. The golf ball 2 has excellent directional stability. Specific examples of the highly dense metals include tungsten and molybdenum. Tungsten is particularly preferred.

The amount of the powder of highly dense metal is preferably equal to or greater than 10 parts by weight, more preferably equal to or greater than 15 parts by weight, and particularly preferably equal to or greater than 22 parts by weight, per 100 parts by weight of the base polymer. In light of ease of producing the golf ball 2, the amount of the powder of the highly dense metal is preferably equal to or less than 50 parts by weight.

In light of flight distance and directional stability, a difference (SG2−SG1) between the specific gravity SG2 of the mid layer 6 and the specific gravity SG1 of the core 4 is preferably equal to or greater than 0.05, and particularly preferably equal to or greater than 0.10. In light of ease of producing the golf ball 2, the difference (SG2−SG1) is preferably equal to or less than 0.4.

In light of flight distance and the directional stability, the specific gravity SG2 of the mid layer 6 is preferably equal to or greater than 1.15, more preferably equal to or greater than 1.20, and particularly preferably equal to or greater than 1.23. In light of ease of producing the golf ball 2, the specific gravity SG2 is preferably equal to or less than 1.5.

In light of the outer-hard/inner-soft structure being accomplished in a spherical body 14 composed of the core 4 and the mid layer 6, a hardness H2 of the mid layer 6 is preferably equal to or greater than 35, more preferably equal to or greater than 40, and particularly preferably equal to or greater than 45. In light of the feel at impact of the golf ball 2, the hardness H2 is preferably equal to or less than 57, and particularly preferably equal to or less than 55. The hardness H2 is measured with a Shore D type spring hardness scale attached to an automated rubber hardness tester (Kobunshi Keiki Co., Ltd., trade name "P1") in accordance with a standard of "ASTM-D 2240-68". For the measurement, a slab formed by hot press is used having a thickness of about 2 mm. The slab which had been stored at a temperature of 23° C. for two weeks is used for the measurement. When the measurement is carried out, three pieces of the slab are overlaid. The slab constituted with the same resin composition as that of the mid layer 6 is used for the measurement.

In light of the outer-hard/inner-soft structure of the spherical body 14 being accomplished, it is preferable that the hardness H2 of the mid layer 6 is greater than Shore D hardness of the surface of the core 4. The Shore D hardness of the surface of the core 9 is measured with a Shore D type spring hardness scale attached to an automated rubber hardness tester (Kobunshi Keiki Co., Ltd., trade name "P1").

The mid layer 6 has a thickness of preferably equal to or greater than 0.5 mm but equal to or less than 1.2 mm. The spherical body 14 with the mid layer 6 having a thickness of 0.5 mm or greater can achieve the outer-heavy/inner-light structure. In this respect, the thickness is preferably equal to or greater than 0.7 mm, and particularly preferably equal to or greater than 0.8 mm. The golf ball 2 with the mid layer 6 having a thickness of 1.2 mm or less has excellent resilience performance. In this respect, the thickness is particularly preferably equal to or less than 1.0 mm.

For forming the mid layer 6, a known procedure such as injection molding, compression molding or the like may be employed. The mid layer 6 may have two or more layers.

A resin composition is suitably used for the cover 8. Preferable base polymer for the resin composition is an ionomer. The golf ball 2 with the cover 8 including an ionomer resin has excellent resilience performance. Aforementioned ionomer resin in connection with the mid layer 6 may be used for the cover 8.

An ionomer resin and another resin may be used in combination. In this case, the principal component of the base polymer is ionomer resin in light of resilience performance. The proportion of the ionomer resin to the entire base polymer is preferably equal to or greater than 50% by weight, more preferably equal to or greater than 60% by weight, and particularly preferably equal to or greater than 70% by weight.

Other preferable resin which may be used in combination with the ionomer resin is an ethylene-(meth)acrylic acid copolymer. This copolymer is obtained by a copolymerization reaction of a monomer composition containing ethylene and (meth) acrylic acid. In this copolymer, a part of carboxyl groups are neutralized with a metal ion. This copolymer contains 3% by weight or more and 25% by weight or less (meth) acrylic acid component. Ethylene-(meth)acrylic acid copolymers having a polar functional group are particularly preferred. Specific examples of the ethylene-(meth)acrylic acid copolymer include "Nucrel", trade name, available from Du Pont-MITSUI POLYCHEMICALS Co., Ltd.

A preferable resin which may be used in combination with the ionomer resin is a styrene block-containing thermoplastic elastomer. The styrene block-containing thermoplastic elastomer described above in connection with the mid layer 6 may be used in the cover 8.

According to need, a coloring agent such as titanium dioxide, a filler such as barium sulfate, a dispersant, an antioxidant, an ultraviolet absorber, a light stabilizer, a fluorescent material, a fluorescent brightener, and the like are added to the cover 8 in an adequate amount.

The cover 8 has a Shore D hardness H3 of preferably 57 or greater but 66 or less. In the golf ball 2 with the cover 8 having the hardness H3 of 57 or greater, spin is suppressed. The golf ball 2 has excellent flight performance. In this respect, the hardness H3 is particularly preferably equal to or greater than 59. The golf ball 2 with the cover 8 having the hardness H3 of 66 or less provides excellent feel at impact. In this respect, the hardness H3 is particularly preferably equal to or less than 64. The hardness H3 is measured in a similar method to that of the hardness H2.

The cover 8 has a thickness of preferably 0.3 mm or greater but 1.3 mm or less. The cover 8 having a thickness of 0.3 mm or greater can be easily formed. In this respect, the thickness is particularly preferably equal to or greater than 0.4 mm. In the golf ball 2 with the cover 8 having a thickness of 1.3 mm or less, the outer-heavy/inner-light structure can be accomplished. In this respect, the thickness is more preferably equal to or greater than 1.0 mm and particularly preferably equal to or greater than 0.8 mm.

For forming the cover 8, known methods such as injection molding, compression molding, and the like can be used. When forming the cover 8, the dimples 10 are formed by pimples formed on the cavity face of a mold. The cover 8 may have two or more layers.

The Shore D hardness H3 of the cover 8 is greater than the Shore D hardness H2 of the mid layer 6. The cover 8 achieves the outer-hard/inner-soft structure of the golf ball 2. The golf ball 2 has excellent flight performance and feel at impact. A difference (H3−H2) is preferably equal to or greater than 4, and particularly preferably equal to or greater than 6. The difference (H3−H2) is preferably equal to or less than 20.

A sum (W2+W3) of the weight W2 of the mid layer 6 and the weight W3 of the cover 8 is preferably 8.4 g or greater but 12.0 g or less. In the golf ball 2 having the sum (W2+W3) of 8.4 g or greater, the outer-heavy/inner-light structure can be achieved. In this respect, the sum (W2+W3) is more preferably equal to or greater than 8.7 g, and particularly preferably equal to or greater than 9.0 g. In the golf ball 2 having the sum (W2+W3) of 12.0 g or greater, the core is sufficiently great. The great core 4 can achieve excellent resilience performance. In this respect, the sum (W2+W3) is more preferably equal to or less than 11.0 g, and particularly preferably equal to or less than 10.0 g.

A sum (V2+V3) of the volume V2 of the mid layer 6 and the volume V3 of the cover 8 is preferably equal to or less than 10 $cm^3$. In the golf ball 2 having the sum (V2+V3) of 10 $cm^3$ or less, the core 4 is sufficiently great. The great core 4 can achieve excellent resilience performance. In this respect, the sum (V2+V3) is more preferably equal to or less than 9.5 $cm^3$, and particularly preferably equal to or less than 9.0 $cm^3$. The sum (V2+V3) is preferably equal to or greater than 7.0 $cm^3$.

In light of feel at impact, the golf ball 2 has an amount of compressive deformation CD of preferably 2.5 mm or greater, more preferably 2.7 mm or greater, and particularly preferably 2.8 mm or greater. In light of resilience performance, the amount of compressive deformation CD is preferably equal to or less than 4.0 mm, more preferably equal to or less than 3.8 mm, and particularly preferably equal to or less than 3.6 mm.

At measurement of the amount of compressive deformation CD, first, the golf ball 2 is placed on a hard plate made of metal. Next, a cylinder made of metal gradually descends toward the golf ball 2. The golf ball 2, squeezed between the bottom face of the cylinder and the hard plate, becomes deformed. A migration distance of the cylinder, starting from the state in which an initial load of 98 N is applied to the golf ball 2 up to the state in which a final load of 1274 N is applied thereto, is measured.

EXAMPLES

The following will show the effects of the present invention by means of Examples, but the present invention should not be construed in a limited manner based on the description of these Examples.

Example 1

A rubber composition was obtained by kneading 100 parts by weight of a high-cis polybutadiene (trade name "BR-730", manufactured by JSR Corporation), 27.0 parts by weight of zinc diacrylate, 5 parts by weight of zinc oxide, 12.3 parts by weight of barium sulfate, 0.2 parts by weight of 2-naphthalenethiol, and 0.8 parts by weight of dicumyl peroxide. This rubber composition was placed into a mold including upper and lower mold halves each having a hemispherical cavity, and heated at 170° C. for 25 minutes to obtain a core with a diameter of 39.6 mm.

A resin composition was obtained by kneading 34 parts by weight of an ionomer resin (the aforementioned "Surlyn 8945"), 40 parts by weight of another ionomer resin (the aforementioned "Himilan AM7329"), 26 parts by weight of a styrene block-containing thermoplastic elastomer (the aforementioned "Rabalon T3221C"), and 32 parts by weight of tungsten powders with a twin-screw kneading extruder. The core was placed into a mold. The core was covered with the resin composition by injection molding to form a mid layer with a thickness of 0.8 mm.

A resin composition was obtained by kneading 25 parts by weight of an ionomer resin (the aforementioned "Surlyn 8945"), 50 parts by weight of another ionomer resin (the aforementioned "Himilan AM7329"), 25 parts by weight of acrylic acid copolymer ("Nucrel N1050H", trade name, available from Du Pont-MITSUI POLYCHEMICALS Co., Ltd), 3 parts by weight of carbon dioxide, and 0.04 parts by weight of ultramarine blue with a twin-screw kneading extruder. A spherical body including the core and the mid layer was placed into a final mold having a large number of pimples on its cavity face. The core was covered with the resin composition by injection molding to form a cover with a thickness of 0.8 mm. Dimples having a shape that was the inverted shape of the pimples were formed on the cover. A clear paint including a two-component curing type polyurethane as a base material was applied to this cover to obtain a golf ball of Example 1 with a diameter of 42.8 mm.

Examples 2 to 11 and Comparative Examples 1 to 7

Golf balls of Examples 2 to 11 and Comparative Examples 1 to 7 were obtained in the same manner as Example 1, except the specifications of the core, mid layer and cover were changed.

Comparative Example 8

A rubber composition was obtained by kneading 100 parts by weight of a high-cis polybutadiene (the aforementioned "BR-730"), 21.5 parts by weight of zinc diacrylate, 5 parts by weight of zinc oxide, 14.5 parts by weight of barium sulfate, 0.5 parts by weight of diphenyl disulfide, and 0.8 parts by weight of dicumyl peroxide. This rubber composition was placed into a mold including upper and lower mold halves each having a hemispherical cavity, and heated at 170° C. for 25 minutes to obtain a center with a diameter of 25.0 mm.

A rubber composition was obtained by kneading 100 parts by weight of a high-cis polybutadiene (the aforementioned "BR-730"), 33.0 parts by weight of zinc diacrylate, 5 parts by weight of zinc oxide, 9.8 parts by weight of barium sulfate, 0.5 parts by weight of diphenyl disulfide, and 0.8 parts by weight of dicumyl peroxide. Half shells were formed from this rubber composition. The center was covered with two half shells. The center and the half shells were placed into a mold including upper and lower mold halves each having a hemispherical cavity, and heated at 170° C. for 25 minutes to obtain a core with a diameter of 39.6 mm. The core consists of the center and an envelope layer. The core was covered with a cover in the same manner as Example 1. Further, a clear paint was applied in the same manner as Example 1, to obtain a golf ball of Comparative Example 8.

[Flight Test]

A driver with a titanium head (trade name "XXIO", manufactured by SRI Sports Limited, shaft hardness: S, loft angle: 10.0°) was attached to a swing machine manufactured by True Temper Co. A golf ball was hit under the condition of a head speed of 45 m/sec. The ball speed immediately after the hit and the distance from the launch point to the stop point were measured. The average value of data obtained by 10 measurements is shown in Tables 11 to 14 below.

[Evaluation of Directional Stability]

A driver with a titanium head (SRI Sports Limited, trade name "XXIO", shaft hardness: S, loft angle: 10.0°) was attached to a swing machine manufactured by True Temper Co. so as to have a 2° open face. Then the golf ball was hit under a condition to give the head speed of 45 m/sec, and the distance between the landing point and a line in the intended direction was measured. The measurement was carried out 10 times to derive a first mean value. The driver was attached so as to have a 2° closed face. Then the golf ball was hit under a condition to give the head speed of 45 m/sec, and the distance between the landing point and a line in the intended direction was measured. The measurement was carried out 10 times to derive a second mean value. The sum total of the first mean value and the second mean value is shown in Tables 11 to 14 below. The smaller values are more preferable.

[Durability Test]

A golf ball was kept in the environment of 23° C. for 12 hours. A driver with a titanium head (trade name "XXIO", available from SRI Sports Limited, shaft hardness: S, loft angle: 10.0°) was attached to a swing machine, manufactured by True Temper Co. The golf ball was repeatedly hit under the condition of a head speed of 45 m/sec. The number of hits required to break the golf ball was counted. An index of the average value of data obtained by 12 measurements is shown in Tables 11 to 14 below. The greater values are more preferable.

TABLE 1

| Composition of Core (parts by weight) | | | | | |
|---|---|---|---|---|---|
| | Example 1 | Example 2 | Example 3 | Example 4 | Example 5 |
| Polybutadiene | 100 | 100 | 100 | 100 | 100 |
| Zinc diacrylate | 27.0 | 37.0 | 25.0 | 43.0 | 24.0 |
| Zinc oxide | 5 | 5 | 5 | 5 | 5 |
| Barium sulfate | 12.3 | 7.5 | 13.2 | 4.5 | 13.6 |
| 2-naphthalenethiol | 0.2 | 2.0 | 0.08 | 3.5 | 0.03 |
| Dicumyl peroxide | 0.8 | 0.8 | 0.8 | 0.8 | 0.8 |
| Specific Gravity | 1.116 | 1.116 | 1.116 | 1.116 | 1.116 |

TABLE 2

| Composition of Core (parts by weight) | | | | | | |
|---|---|---|---|---|---|---|
| | Example 6 | Example 7 | Example 8 | Example 9 | Example 10 | Example 11 |
| Polybutadiene | 100 | 100 | 100 | 100 | 100 | 100 |
| Zinc diacrylate | 27.0 | 27.0 | 27.0 | 27.0 | 27.0 | 27.0 |
| Zinc oxide | 5 | 5 | 5 | 5 | 5 | 5 |
| Barium sulfate | 13.7 | 14.4 | 10.8 | 12.3 | 18.9 | 12.3 |
| 1-naphthalenethiol | — | — | — | — | — | 0.2 |
| 2-naphthalenethiol | 0.2 | 0.2 | 0.2 | 0.2 | 0.2 | — |
| Dicumyl peroxide | 0.8 | 0.8 | 0.8 | 0.8 | 0.8 | 0.8 |
| Specific Gravity | 1.124 | 1.128 | 1.107 | 1.116 | 1.153 | 1.116 |

TABLE 3

| Composition of Core (parts by weight) | | | | | |
|---|---|---|---|---|---|
| | Comp. Example 1 | Comp. Example 2 | Comp. Example 3 | Comp. Example 4 | Comp. Example 5 |
| Polybutadiene | 100 | 100 | 100 | 100 | 100 |
| Zinc diacrylate | 28.0 | 25.0 | 30.0 | 25.5 | 39.0 |
| Zinc oxide | 5 | 5 | 5 | 5 | 5 |
| Barium sulfate | 11.8 | 13.2 | 11 | 12.8 | 7 |
| Bis(pentabromophenyl)disulfide | — | — | — | 0.5 | — |
| Diphenyl disulfide | 0.5 | — | — | — | — |
| 2-naphthalenethiol | — | 0.2 | — | — | — |
| Pentachlorothiophenol | — | — | 0.6 | — | — |
| Dicumyl peroxide | 0.8 | 0.8 | 0.8 | 0.8 | — |
| 1,1-di(t-butylperoxy)cyclohexane | — | — | — | — | 3.0 |
| 2,2'-methylenebis(4-methyl-6-t-butylphenol) | — | — | — | — | 0.1 |
| Zinc stearate | — | — | — | — | 5.0 |
| Sulfur | — | — | — | — | 0.1 |
| Zinc salt of pentachlorothiophenol | — | — | — | — | 0.5 |
| Specific Gravity | 1.116 | 1.116 | 1.116 | 1.116 | 1.116 |

TABLE 4

| Composition of Core (parts by weight) | | | | |
|---|---|---|---|---|
| | | | Comp. Example 8 | |
| | Comp. Example 6 | Comp. Example 7 | Center | Envelope layer |
| Polybutadiene | 100 | 100 | 100 | 100 |
| Zinc diacrylate | 27.0 | 27.0 | 21.5 | 33.0 |
| Zinc oxide | 5 | 5 | 5 | 5 |
| Barium sulfate | 12.3 | 12.3 | 14.5 | 9.8 |
| Diphenyl disulfide | — | — | 0.5 | 0.5 |
| 2-naphthalenethiol | — | 0.2 | — | — |
| Dicumyl peroxide | 1.5 | 0.8 | 0.8 | 0.8 |
| 2,2'-methylenebis(4-methyl-6-t-butylphenol) | 0.5 | — | — | — |
| Specific Gravity | 1.116 | 1.116 | 1.116 | 1.116 |

The details of the compounds listed in Tables 1 to 4 are as follows.

Bis(pentabromophenyl)disulfide: Sankyo Kasei Co., Ltd.

Diphenyl disulfide: Sumitomo Seika Chemicals Co., Ltd.

1-naphthalenethiol: Alfa Aesar.

2-naphthalenethiol: Tokyo Chemical Industry Co., Ltd.

Pentachlorothiophenol: Tokyo Chemical Industry Co., Ltd.

Dicumyl peroxide: NOF Corporation.

1,1-di(t-butylperoxy)cyclohexane: trade name "Perhexa C-40", manufactured by NOF Corporation.

2,2'-methylenebis(4-methyl-6-t-butylphenol): trade name "Nocrac NS-6", manufactured by Ouchi Shinko Chemical Industrial Co., Ltd.

Zinc stearate: NOF Corporation.

Sulfur: trade name "Sulfur Z", manufactured by Tsurumi Chemical Industry Co., Ltd.

TABLE 5

| Composition of Mid Layer (parts by weight) | | | | |
|---|---|---|---|---|
| | (a) | (b) | (c) | (d) |
| Surlyn 8945 | 34 | 34 | 34 | 34 |
| Himilan AM7329 | 40 | 40 | 40 | 40 |
| Rabalon T3221C | 26 | 26 | 26 | 26 |
| Tungsten | — | 22 | 26 | 32 |
| Hardness H2 (Shore D) | 50 | 50 | 50 | 50 |
| Specific Gravity SG2 | 0.94 | 1.14 | 1.17 | 1.23 |

TABLE 6

| Composition of Cover (parts by weight) | | | |
|---|---|---|---|
| | (e) | (f) | (g) |
| Surlyn 8945 | 25 | 25 | 25 |
| Himilan AM7329 | 50 | 45 | 38 |
| Nucrel N1050H | 25 | 25 | 25 |
| Rabalon T3221C | — | 5 | 12 |
| Titanium dioxide | 3 | 3 | 3 |
| Ultramarine blue | 0.04 | 0.04 | 0.04 |
| Hardness H3 (Shore D) | 60 | 56 | 48 |
| Specific Gravity SG3 | 0.98 | 0.98 | 0.98 |

TABLE 7

Figure 3:
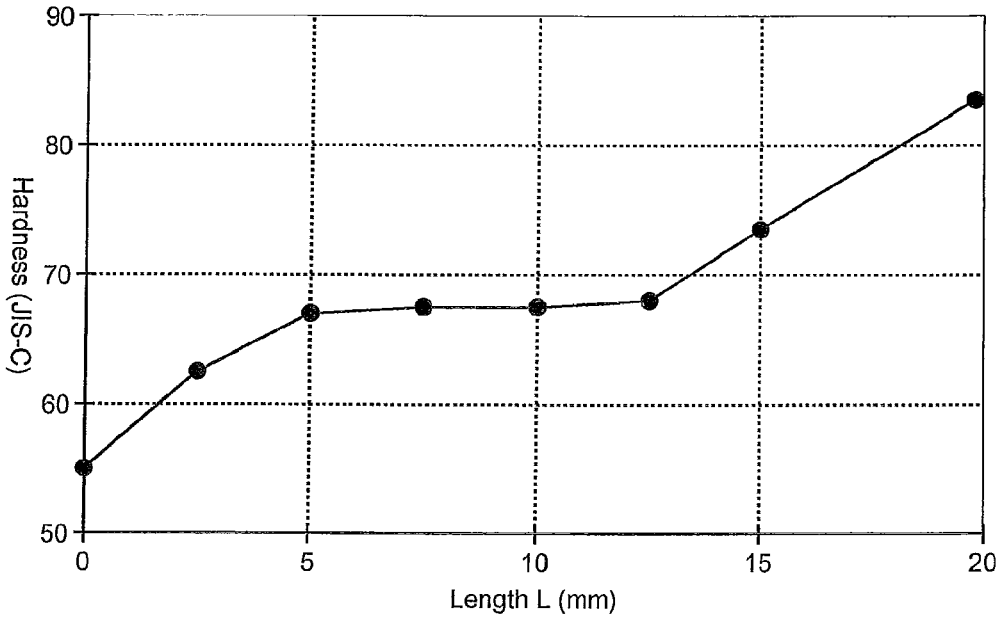
FIG. 3 is a graph showing a hardness distribution of a core of a golf ball according to Example 2.
Figure 4:
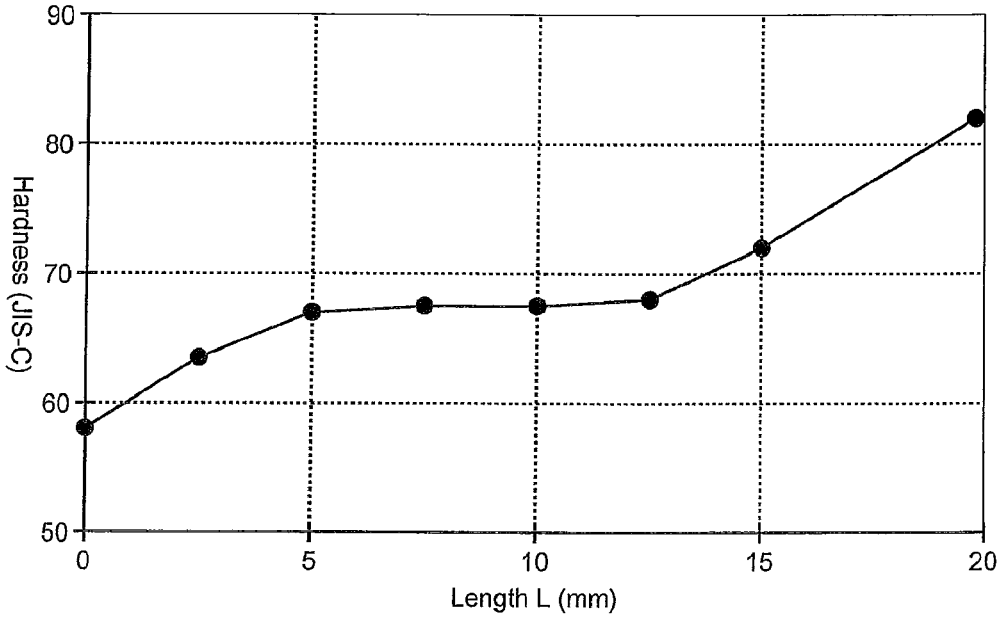
FIG. 4 is a graph showing a hardness distribution of a core of a golf ball according to Example 3.
Figure 5:
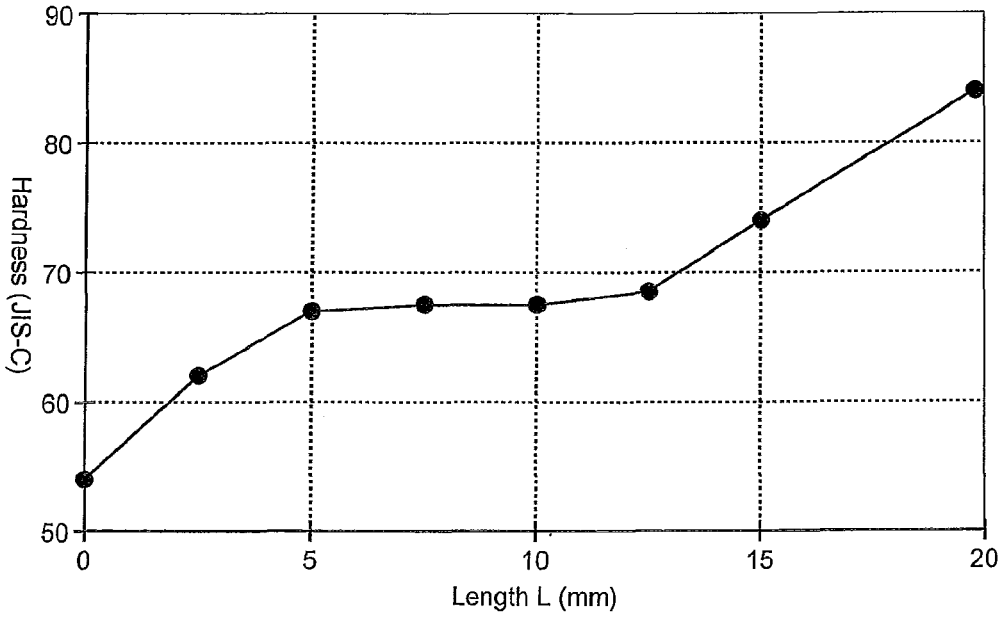
FIG. 5 is a graph showing a hardness distribution of a core of a golf ball according to Example 4.
Figure 6:
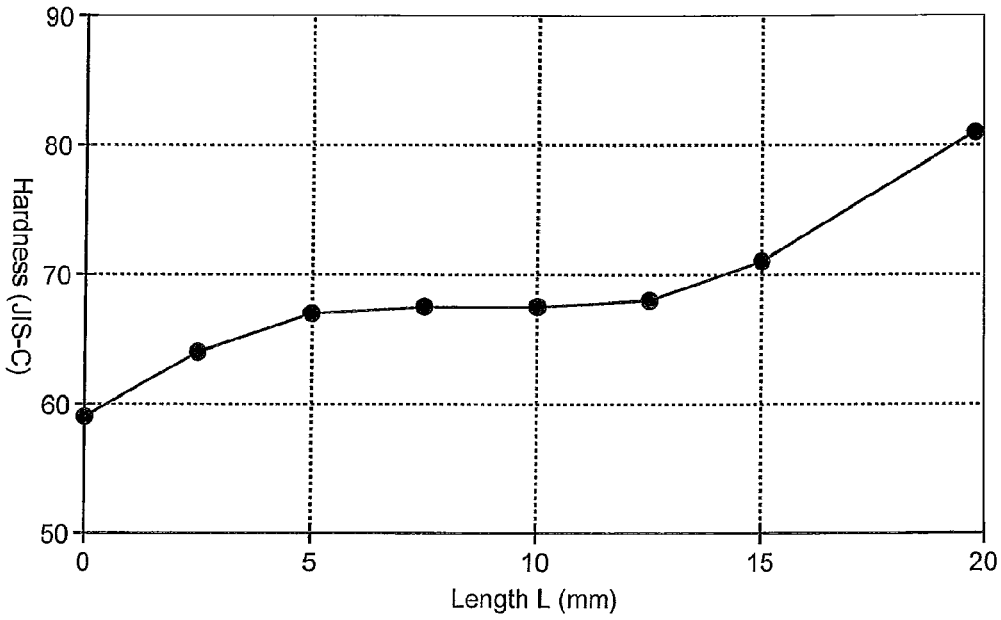
FIG. 6 is a graph showing a hardness distribution of a core of a golf ball according to Example 5.

| Specification of Golf Balls | | | | | | |
|---|---|---|---|---|---|---|
| | | Example 1 | Example 2 | Example 3 | Example 4 | Example 5 |
| Core | Cross-linking temperature (° C.) | 170 | 170 | 170 | 170 | 170 |
| | Crosslinking time (min) | 25 | 25 | 25 | 25 | 25 |
| | Diameter (mm) | 39.6 | 39.6 | 39.6 | 39.6 | 39.6 |
| | Specific Gravity SG1 | 1.116 | 1.116 | 1.116 | 1.116 | 1.116 |
| Hardness of core (JIS-C) | Ho | 56.0 | 55.0 | 58.0 | 54.0 | 59.0 |
| | H(2.5) | 63.0 | 62.5 | 63.5 | 62.0 | 64.0 |
| | H(5.0) | 67.0 | 67.0 | 67.0 | 67.0 | 67.0 |
| | H(7.5) | 67.5 | 67.5 | 67.5 | 67.5 | 67.5 |
| | H(10.0) | 67.5 | 67.5 | 67.5 | 67.5 | 67.5 |
| | H(12.5) | 68.0 | 68.0 | 68.0 | 68.5 | 68.0 |
| | H(12.6) | — | — | — | — | — |
| | H(15.0) | 73.0 | 73.5 | 72.0 | 74.0 | 71.0 |
| | Hs | 83.0 | 83.5 | 82.0 | 84.0 | 81.0 |
| | Graph | FIG. 2 | FIG. 3 | FIG. 4 | FIG. 5 | FIG. 6 |
| Mid layer | Composition | (d) | (d) | (d) | (d) | (d) |
| | Harness H2 (Shore D) | 50 | 50 | 50 | 50 | 50 |
| | Thickness (mm) | 0.8 | 0.8 | 0.8 | 0.8 | 0.8 |
| | Volume V2 ($mm^3$) | 4.1 | 4.1 | 4.1 | 4.1 | 4.1 |
| | Specific Gravity SG2 | 1.23 | 1.23 | 1.23 | 1.23 | 1.23 |
| | Weight W2 (g) | 5.05 | 5.05 | 5.05 | 5.05 | 5.05 |
| Cover | Composition | (e) | (e) | (e) | (e) | (e) |
| | Hardness H3 (Shore D) | 60 | 60 | 60 | 60 | 60 |
| | Thickness (mm) | 0.8 | 0.8 | 0.8 | 0.8 | 0.8 |
| | Volume V3 ($mm^3$) | 4.43 | 4.43 | 4.43 | 4.43 | 4.43 |
| | Specific Gravity SG3 | 0.98 | 0.98 | 0.98 | 0.98 | 0.98 |
| | Weight W3 (g) | 4.35 | 4.35 | 4.35 | 4.35 | 4.35 |

TABLE 8

Figure 7:
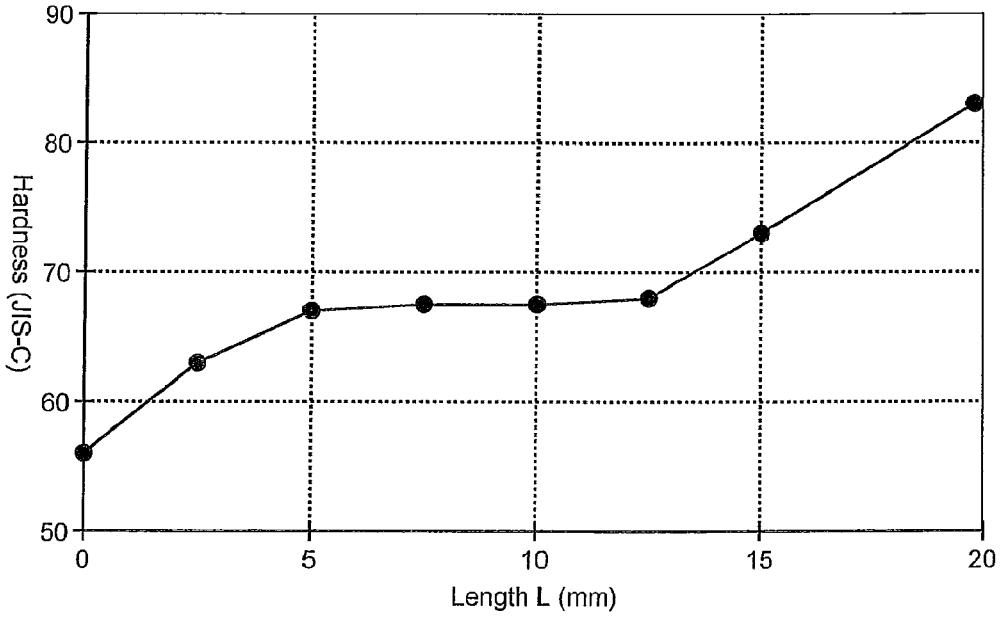
FIG. 7 is a graph showing a hardness distribution of a core of a golf ball according to Example 6.
Figure 8:
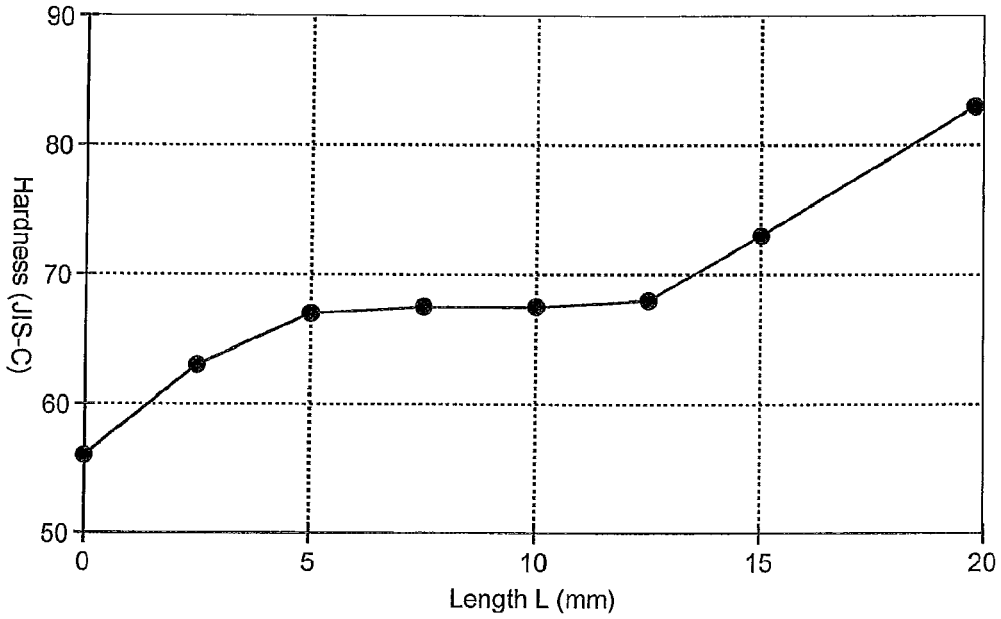
FIG. 8 is a graph showing a hardness distribution of a core of a golf ball according to Example 7.
Figure 9:
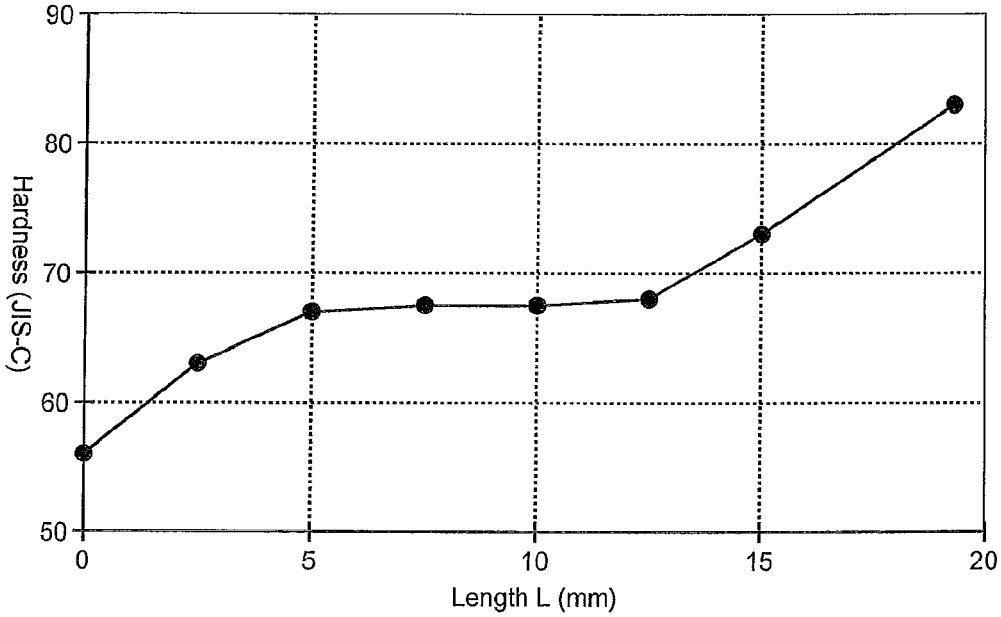
FIG. 9 is a graph showing a hardness distribution of a core of a golf ball according to Example 8.
Figure 10:
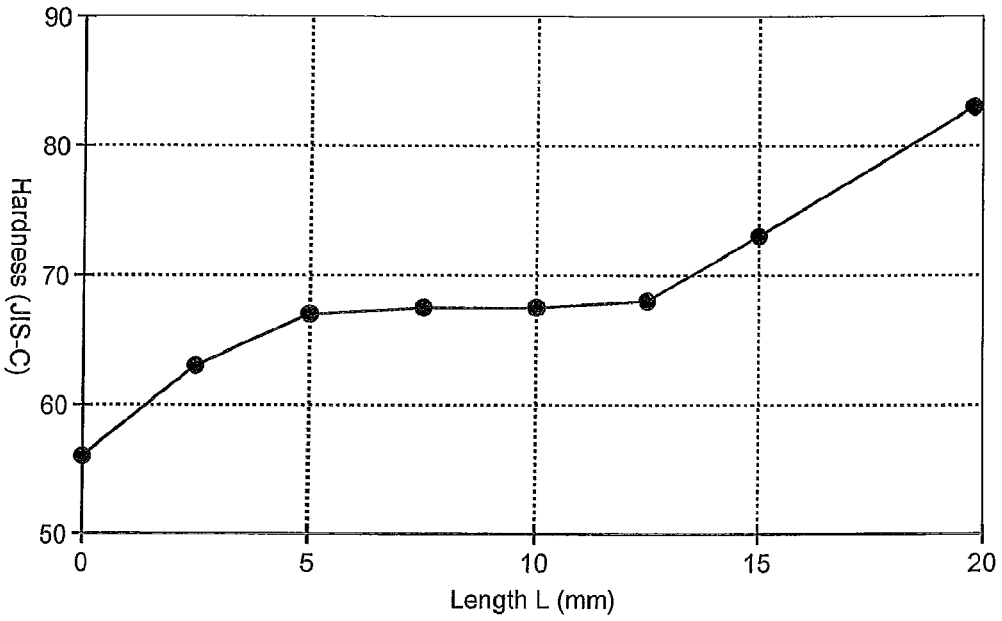
FIG. 10 is a graph showing a hardness distribution of a core of a golf ball according to Example 10.
Figure 11:
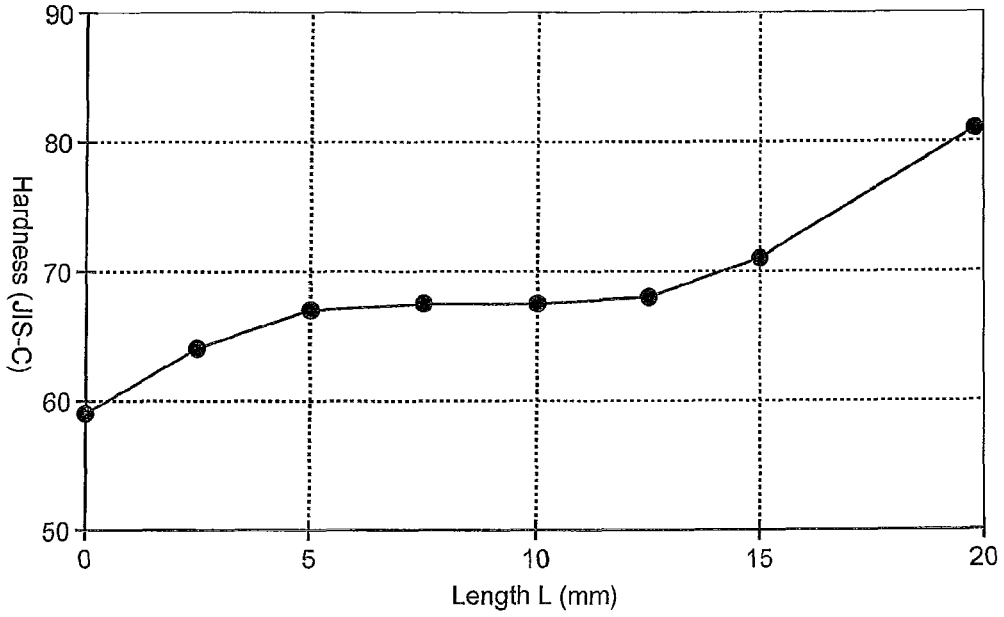
FIG. 11 is a graph showing a hardness distribution of a core of a golf ball according to Example 11.

| Specification of Golf Balls | | | | | | | |
|---|---|---|---|---|---|---|---|
| | | Example 6 | Example 7 | Example 8 | Example 9 | Example 10 | Example 11 |
| Core | Crosslinking temperature (° C.) | 170 | 170 | 170 | 170 | 170 | 170 |
| | Crosslinking time (min) | 25 | 25 | 25 | 25 | 25 | 25 |
| | Diameter (mm) | 39.6 | 39.6 | 38.6 | 39.6 | 39.6 | 39.6 |
| | Specific Gravity SG1 | 1.124 | 1.128 | 1.107 | 1.116 | 1.153 | 1.116 |
| Hardness of core (JIS-C) | Ho | 56.0 | 56.0 | 56.0 | 56.0 | 56.0 | 59.0 |
| | H(2.5) | 63.0 | 63.0 | 63.0 | 63.0 | 63.0 | 64.0 |
| | H(5.0) | 67.0 | 67.0 | 67.0 | 67.0 | 67.0 | 67.0 |
| | H(7.5) | 67.5 | 67.5 | 67.5 | 67.5 | 67.5 | 67.5 |
| | H(10.0) | 67.5 | 67.5 | 67.5 | 67.5 | 67.5 | 67.5 |
| | H(12.5) | 68.0 | 68.0 | 68.0 | 68.0 | 68.0 | 68.0 |
| | H(12.6) | — | — | — | — | — | — |
| | H(15.0) | 73.0 | 73.0 | 73.0 | 73.0 | 73.0 | 71.0 |
| | Hs | 83.0 | 83.0 | 83.0 | 83.0 | 83.0 | 81.0 |
| | Graph | FIG. 7 | FIG. 8 | FIG. 9 | FIG. 2 | FIG. 10 | FIG. 11 |

TABLE 8-continued

| Specification of Golf Balls | | | | | | | |
|---|---|---|---|---|---|---|---|
| | | Example 6 | Example 7 | Example 8 | Example 9 | Example 10 | Example 11 |
| Mid layer | Composition | (c) | (b) | (d) | (d) | (a) | (d) |
| | Hardness H2 (Shore D) | 50 | 50 | 50 | 50 | 50 | 50 |
| | Thickness (mm) | 0.8 | 0.8 | 1.3 | 0.8 | 0.8 | 0.8 |
| | Volume V2 ($mm^3$) | 4.1 | 4.1 | 6.5 | 4.1 | 4.1 | 4.1 |
| | Specific Gravity SG2 | 1.17 | 1.14 | 1.23 | 1.23 | 0.94 | 1.23 |
| | Weight W2 (g) | 4.80 | 4.68 | 8.00 | 5.05 | 3.86 | 5.05 |
| Cover | Composition | (e) | (e) | (e) | (f) | (e) | (e) |
| | Hardness H3 (Shore D) | 60 | 60 | 60 | 56 | 60 | 60 |
| | Thickness (mm) | 0.8 | 0.8 | 0.8 | 0.8 | 0.8 | 0.8 |
| | Volume V3 ($mm^3$) | 4.43 | 4.43 | 4.43 | 4.43 | 4.43 | 4.43 |
| | Specific Gravity SG3 | 0.98 | 0.98 | 0.98 | 0.98 | 0.98 | 0.98 |
| | Weight W3 (g) | 4.35 | 4.35 | 4.35 | 4.35 | 4.35 | 4.35 |

TABLE 9

Figure 12:
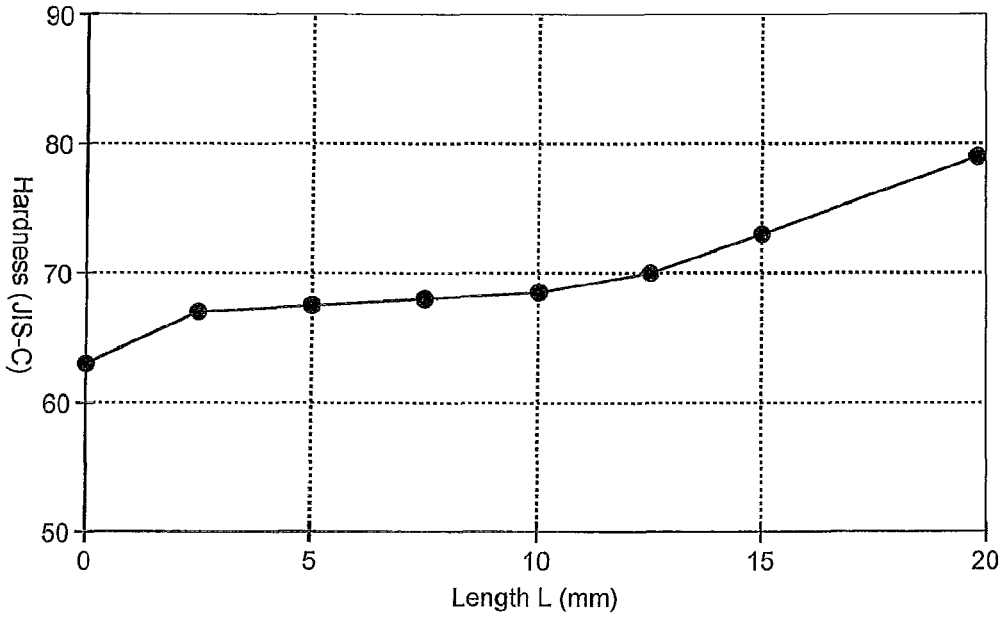
FIG. 12 is a graph showing a hardness distribution of a core of a golf ball according to Comparative Example 1.
Figure 13:
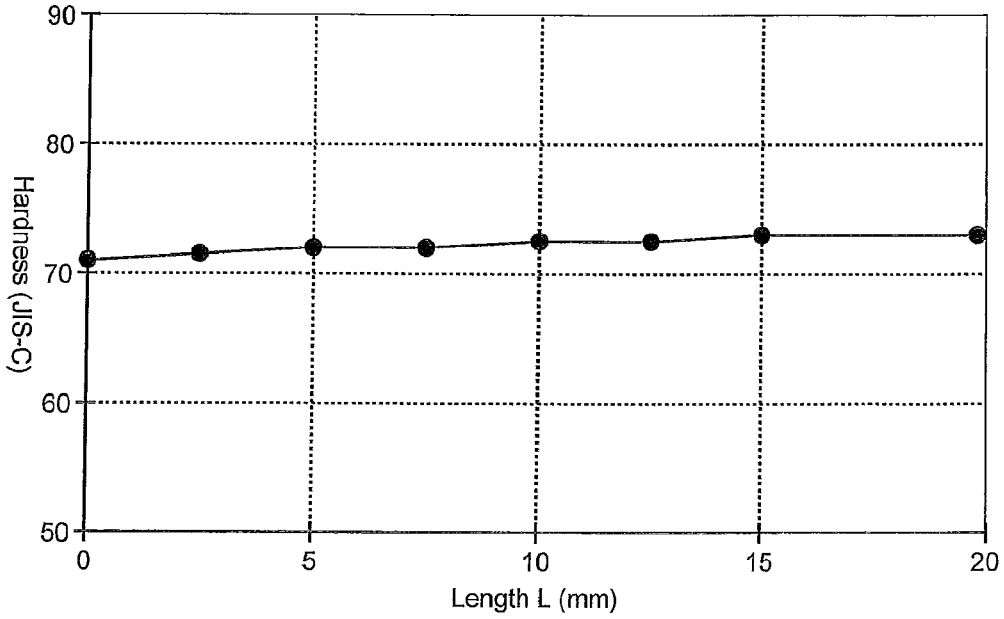
FIG. 13 is a graph showing a hardness distribution of a core of a golf ball according to Comparative Example 2.
Figure 14:
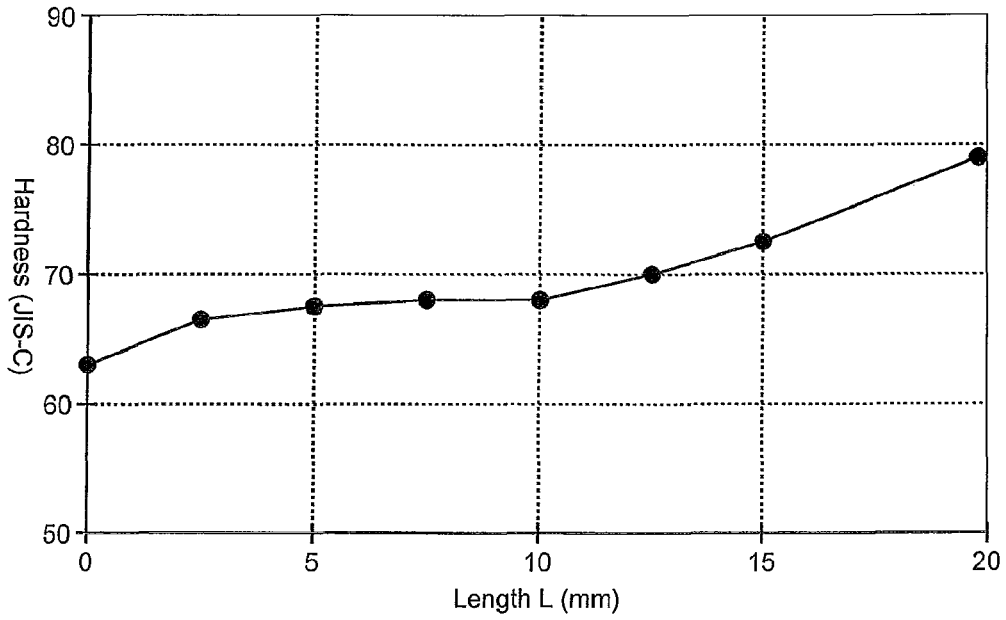
FIG. 14 is a graph showing a hardness distribution of a core of a golf ball according to Comparative Example 3.
Figure 15:
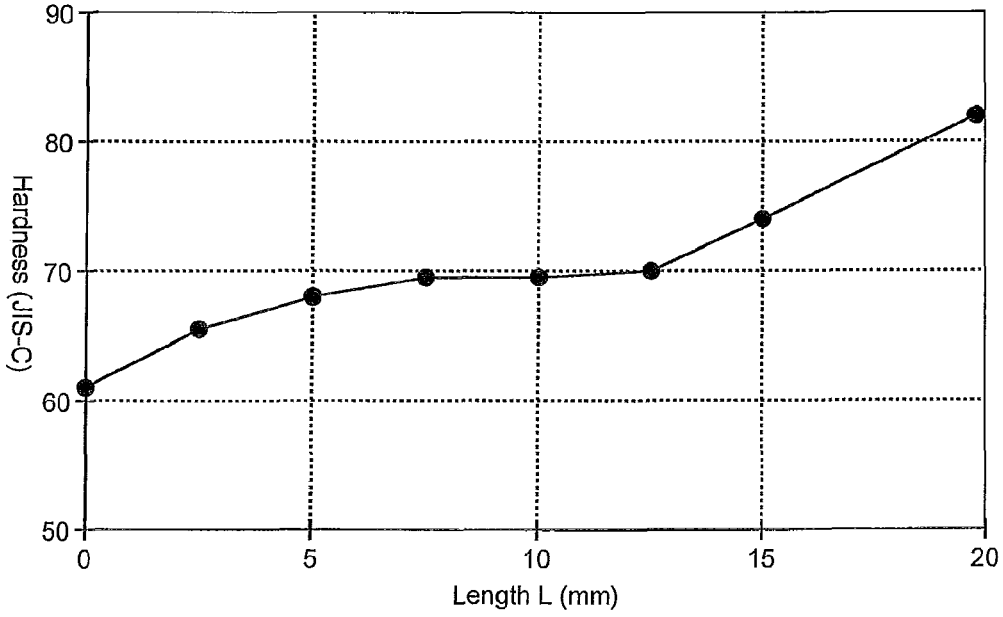
FIG. 15 is a graph showing a hardness distribution of a core of a golf ball according to Comparative Example 4.
Figure 16:
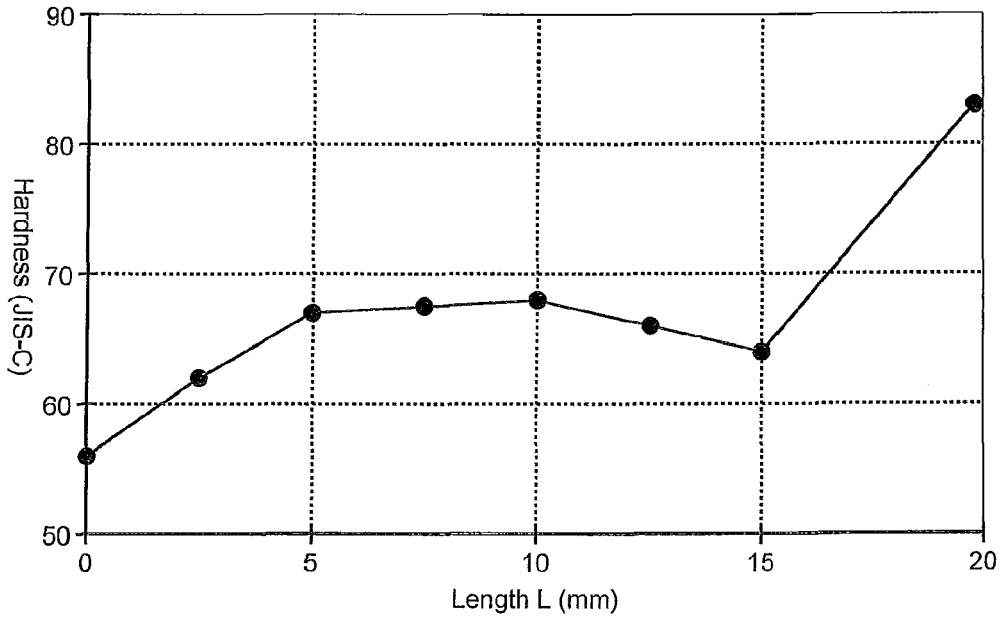
FIG. 16 is a graph showing a hardness distribution of a core of a golf ball according to Comparative Example 5.

| Specification of Golf Balls | | | | | | |
|---|---|---|---|---|---|---|
| | | Comp. Example 1 | Comp. Example 2 | Comp. Example 3 | Comp. Example 4 | Comp. Example 5 |
| Core | Crosslinking temperature (° C.) | 170 | 155 | 170 | 170 | 160 |
| | Crosslinking time (min) | 25 | 40 | 25 | 25 | 25 |
| | Diameter (mm) | 39.6 | 39.6 | 39.6 | 39.6 | 39.6 |
| | Specific Gravity SG1 | 1.116 | 1.116 | 1.116 | 1.116 | 1.116 |
| Hardness of core (JIS-C) | Ho | 63.0 | 71.0 | 63.0 | 61.0 | 56.0 |
| | H(2.5) | 67.0 | 71.5 | 66.5 | 65.5 | 62.0 |
| | H(5.0) | 67.5 | 72.0 | 67.5 | 68.0 | 67.0 |
| | H(7.5) | 68.0 | 72.0 | 68.0 | 69.5 | 67.5 |
| | H(10.0) | 68.5 | 72.5 | 68.0 | 69.5 | 68.0 |
| | H(12.5) | 70.0 | 72.5 | 70.0 | 70.0 | 66.0 |
| | H(12.6) | — | — | — | — | — |
| | H(15.0) | 73.0 | 73.0 | 72.5 | 74.0 | 64.0 |
| | Hs | 79.0 | 73.0 | 79.0 | 82.0 | 83.0 |
| | Graph | FIG. 12 | FIG. 13 | FIG. 14 | FIG. 15 | FIG. 16 |
| Mid layer | Composition | (d) | (d) | (d) | (d) | (d) |
| | Hardness H2 (Shore D) | 50 | 50 | 50 | 50 | 50 |
| | Thickness (mm) | 0.8 | 0.8 | 0.8 | 0.8 | 0.8 |
| | Volume V2 ($mm^3$) | 4.1 | 4.1 | 4.1 | 4.1 | 4.1 |
| | Specific Gravity SG2 | 1.23 | 1.23 | 1.23 | 1.23 | 1.23 |
| | Weight W2 (g) | 5.05 | 5.05 | 5.05 | 5.05 | 5.05 |
| Cover | Composition | (e) | (e) | (e) | (e) | (e) |
| | Hardness H3 (Shore D) | 60 | 60 | 60 | 60 | 60 |
| | Thickness (mm) | 0.8 | 0.8 | 0.8 | 0.8 | 0.8 |
| | Volume V3 ($mm^3$) | 4.43 | 4.43 | 4.43 | 4.43 | 4.43 |
| | Specific Gravity SG3 | 0.98 | 0.98 | 0.98 | 0.98 | 0.98 |
| | Weight W3 (g) | 4.35 | 4.35 | 4.35 | 4.35 | 4.35 |

TABLE 10

| Specification of Golf Balls | | | | | |
|---|---|---|---|---|---|
| | | | | Comp. Example 8 | |
| | | Comp. Example 6 | Comp. Example 7 | Center | Envelope layer |
| Core | Crosslinking temperature (° C.) | 162 | 170 | 170 | 170 |
| | Crosslinking time (min) | 23 | 25 | 25 | 25 |
| | Diameter (mm) | 39.6 | 39.6 | 25.0 | 39.6 |
| | Specific Gravity SG1 | 1.116 | 1.116 | 1.116 | |
| Hardness of core (JIS-C) | Ho | 64.0 | 56.0 | 53.0 | |
| | H(2.5) | 68.0 | 63.0 | 57.0 | |
| | H(5.0) | 71.0 | 67.0 | 58.0 | |
| | H(7.5) | 71.0 | 67.5 | 60.0 | |
| | H(10.0) | 71.0 | 67.5 | 64.0 | |
| | H(12.5) | 74.0 | 68.0 | 68.0 | |
| | H(12.6) | — | — | 77.0 | |

TABLE 10-continued

Figure 17:
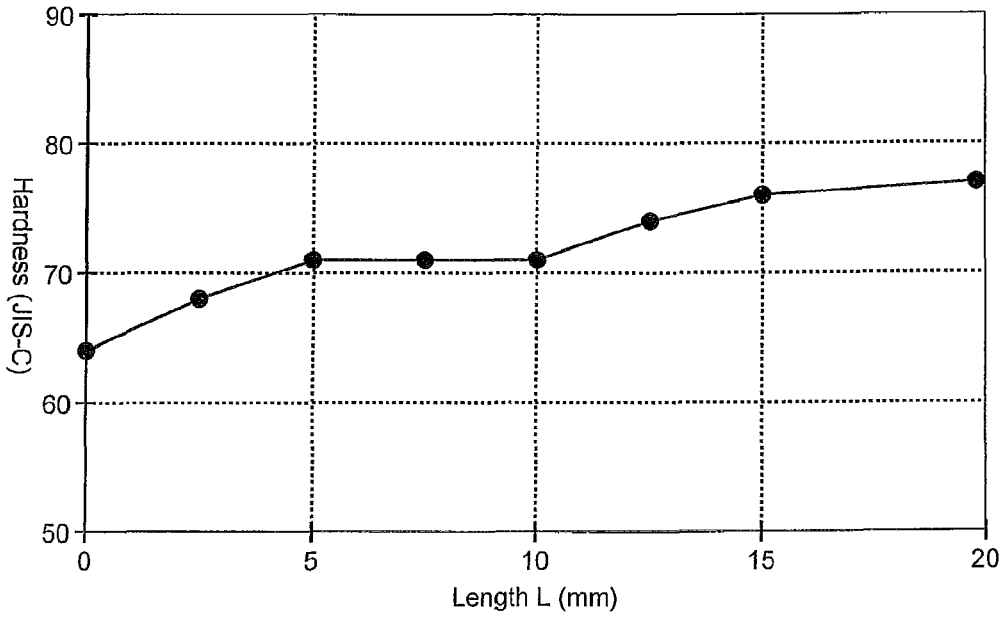
FIG. 17 is a graph showing a hardness distribution of a core of a golf ball according to Comparative Example 6.
Figure 18:
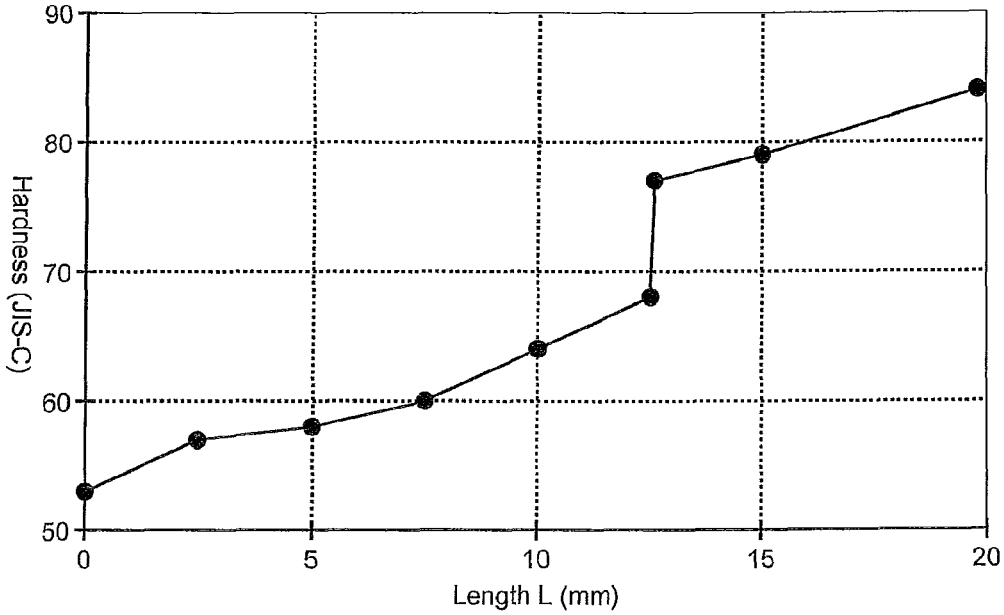
FIG. 18 is a graph showing a hardness distribution of a core of a golf ball according to Comparative Example 8.

| Specification of Golf Balls | | | | | |
|---|---|---|---|---|---|
| | | | | Comp. Example 8 | |
| | | Comp. Example 6 | Comp. Example 7 | Center | Envelope layer |
| | H(15.0) | 76.0 | 73.0 | 79.0 | |
| | Hs | 77.0 | 83.0 | 84.0 | |
| | Graph | FIG. 17 | FIG. 2 | FIG. 18 | |
| Mid layer | Composition | (d) | (d) | (d) | |
| | Hardness H2 (Shore D) | 50 | 50 | 50 | |
| | Thickness (mm) | 0.8 | 0.8 | 0.8 | |
| | Volume V2 ($mm^3$) | 4.1 | 4.1 | 4.1 | |
| | Specific Gravity SG2 | 1.23 | 1.23 | 1.23 | |
| | Weight W2 (g) | 5.05 | 5.05 | 5.05 | |
| Cover | Composition | (e) | (g) | (e) | |
| | Hardness H3 (Shore D) | 60 | 48 | 60 | |
| | Thickness (mm) | 0.8 | 0.8 | 0.8 | |
| | Volume V3 ($mm^3$) | 4.43 | 4.43 | 4.43 | |
| | Specific Gravity SG3 | 0.98 | 0.98 | 0.98 | |
| | Weight W3 (g) | 4.35 | 4.35 | 4.35 | |

TABLE 11

| Results of Evaluation | | | | | |
|---|---|---|---|---|---|
| | Example 1 | Example 2 | Example 3 | Example 4 | Example 5 |
| H(5.0) − Ho | 11.0 | 12.0 | 9.0 | 13.0 | 8.0 |
| H(12.5) − H(5.0) | 1.0 | 1.0 | 1.0 | 1.5 | 1.0 |
| Hs − H(12.5) | 15.0 | 15.5 | 14.0 | 15.5 | 13.0 |
| Hs − Ho | 27.0 | 28.5 | 24.0 | 30.0 | 22.0 |
| H3 − H2 | 10 | 10 | 10 | 10 | 10 |
| SG2 − SG1 | 0.114 | 0.114 | 0.114 | 0.114 | 0.114 |
| SG2 − SG3 | 0.25 | 0.25 | 0.25 | 0.25 | 0.25 |
| W2 + W3 | 9.39 | 9.39 | 9.39 | 9.39 | 9.39 |
| V2 + V3 | 8.54 | 8.54 | 8.54 | 8.54 | 8.54 |
| Amount of compressive deformation CD (mm) | 3.3 | 3.3 | 3.3 | 3.3 | 3.3 |
| Ball speed (m/s) | 64.7 | 64.6 | 64.6 | 64.4 | 64.5 |
| Flight distance (m) | 235 | 234 | 233 | 233 | 232 |
| Directional stability (m) | 4.3 | 4.2 | 4.5 | 4.0 | 4.6 |
| Durability | 98 | 96 | 99 | 95 | 99 |

TABLE 13

| Results of Evaluation | | | | |
|---|---|---|---|---|
| | Comp. Example 1 | Comp. Example 2 | Comp. Example 3 | Comp. Example 4 |
| H(5.0) − Ho | 4.5 | 1.0 | 4.5 | 7.0 |
| H(12.5) − H(5.0) | 2.5 | 0.5 | 2.5 | 2.0 |
| Hs − H(12.5) | 9.0 | 0.5 | 9.0 | 12.0 |
| Hs − Ho | 16.0 | 2.0 | 16.0 | 21.0 |
| H3 − H2 | 10 | 10 | 10 | 10 |
| SG2 − SG1 | 0.114 | 0.114 | 0.114 | 0.114 |
| SG2 − SG3 | 0.25 | 0.25 | 0.25 | 0.25 |
| W2 + W3 | 9.39 | 9.39 | 9.39 | 9.39 |
| V2 + V3 | 8.54 | 8.54 | 8.54 | 8.54 |
| Amount of compressive deformation CD (mm) | 3.3 | 3.3 | 3.3 | 3.3 |
| Ball speed (m/s) | 64.4 | 64.9 | 64.4 | 64.7 |
| Flight distance (m) | 227 | 225 | 226 | 230 |
| Directional stability (m) | 6.5 | 7.2 | 6.5 | 5.3 |
| Durability | 100 | 125 | 100 | 100 |

TABLE 12

| Results of Evaluation | | | | | | |
|---|---|---|---|---|---|---|
| | Example 6 | Example 7 | Example 8 | Example 9 | Example 10 | Example 11 |
| H(5.0) − Ho | 11.0 | 11.0 | 11.0 | 11.0 | 11.0 | 8.0 |
| H(12.5) − H(5.0) | 1.0 | 1.0 | 1.0 | 1.0 | 1.0 | 1.0 |
| Hs − H(12.5) | 15.0 | 15.0 | 15.0 | 15.0 | 15.0 | 13.0 |
| Hs − Ho | 27.0 | 27.0 | 27.0 | 27.0 | 27.0 | 22.0 |
| H3 − H2 | 10 | 10 | 10 | 6 | 10 | 10 |
| SG2 − SG1 | 0.046 | 0.012 | 0.123 | 0.114 | −0.213 | 0.114 |
| SG2 − SG3 | 0.19 | 0.16 | 0.25 | 0.25 | −0.04 | 0.25 |
| W2 + W3 | 9.15 | 9.02 | 12.35 | 9.39 | 8.20 | 9.39 |
| V2 + V3 | 8.54 | 8.54 | 10.94 | 8.54 | 8.54 | 8.54 |
| Amount of compressive deformation CD (mm) | 3.3 | 3.3 | 3.3 | 3.4 | 3.3 | 3.3 |
| Ball speed (m/s) | 64.7 | 64.7 | 64.4 | 64.5 | 64.7 | 64.6 |
| Flight distance (m) | 235 | 235 | 232 | 231 | 234 | 232 |
| Directional stability (m) | 4.5 | 4.8 | 4.6 | 5.0 | 5.3 | 4.9 |
| Durability | 98 | 98 | 98 | 102 | 98 | 99 |

TABLE 14

| Results of Evaluation | | | | |
|---|---|---|---|---|
| | Comp. Example 5 | Comp. Example 6 | Comp. Example 7 | Comp. Example 8 |
| H(5.0) − Ho | 11.0 | 7.0 | 11.0 | 5.0 |
| H(12.5) − H(5.0) | −1.0 | 3.0 | 1.0 | 10.0 |
| Hs − H(12.5) | 17.0 | 3.0 | 15.0 | 16.0 |
| Hs − Ho | 27.0 | 13.0 | 27.0 | 31.0 |
| H3 − H2 | 10 | 10 | −2 | 10 |
| SG2 − SG1 | 0.114 | 0.114 | 0.114 | 0.114 |
| SG2 − SG3 | 0.25 | 0.25 | 0.25 | 0.25 |
| W2 + W3 | 9.39 | 9.39 | 9.39 | 9.39 |
| V2 + V3 | 8.54 | 8.54 | 8.54 | 8.54 |
| Amount of compressive deformation CD (mm) | 3.3 | 3.3 | 3.5 | 3.3 |
| Ball speed (m/s) | 63.9 | 64.0 | 64.2 | 64.2 |
| Flight distance (m) | 222 | 221 | 226 | 233 |
| Directional stability (m) | 4.2 | 7.0 | 7.0 | 4.2 |
| Durability | 95 | 105 | 106 | 60 |

As shown in Tables 11 to 14, the golf balls according to Examples are excellent in various performance characteristics. From the results of evaluation, advantages of the present invention are clear.

The golf ball according to the present invention can be used for playing golf on a golf course and practicing at a driving range. This is merely one example.

The above description is merely for illustrative examples, and various modifications can be made without departing from the principles of the present invention.

What is claimed is:

1. A golf ball comprising a core formed by crosslinking a rubber composition including a base rubber and from 0.05 parts by weight to 3.0 parts by weight of 2-naphthalenethiol based upon 100 parts by weight of said base rubber, a mid layer positioned outside the core, and a cover positioned outside the mid layer, wherein a difference between: a JIS-C hardness H(5.0) at a point which is located at a distance of 5 mm from a central point of the core; and a JIS-C hardness Ho at the central point is equal to or greater than 6.0, a difference between: a JIS-C hardness H(12.5) at a point which is located at a distance of 12.5 mm from the central point; and the JIS-C hardness H(5.0) is equal to or less than 3.0, a difference between a JIS-C hardness Hs at a surface of the core and the JIS-C hardness H(12.5) is equal to or greater than 10.0, the JIS-C hardness H(12.5) is smaller than the average value of the JIS-C hardness H(10) at a point which is located at a distance of 10.0 mm from the central point of the core and the JIS-C hardness H(15) at a point which is located at a distance of 15.0 mm from the central point of the core, a difference between the JIS-C hardness Hs and the JIS-C hardness Ho is equal to or greater than 22.0, a difference between the JIS-C hardness H(5.0) and the JIS-C hardness Ho is smaller than a difference between the JIS-C hardness Hs and the JIS-C hardness H(12.5), wherein a difference between the JIS-C hardness H(12.5) and the JIS-C hardness H(5.0) is equal to or less than 1.5, and a difference between the JIS-C hardness Hs and the JIS-C hardness H(12.5) is equal to or greater than 13.0, there is no zone in which a hardness decreases from the central point toward the surface, the mid layer is constituted with a resin composition, and the base polymer of the mid layer include an ionomer resin as a principal component, and a Shore D hardness H3 of the cover is greater than a Shore D hardness H2 of the mid layer.

2. The golf ball according to claim 1, wherein a specific gravity SG2 of the mid layer is greater than a specific gravity SG1 of the core.

3. The golf ball according to claim 2, wherein a difference (SG2−SG1) between the specific gravity SG2 of the mid layer and the specific gravity SG1 of the core is equal to or greater than 0.05 but equal to or less than 0.4.

4. The golf ball according to claim 1, wherein the JIS-C hardness Ho is equal to or greater than 40.0 but equal to or less than 70.0, and the JIS-C hardness Hs is equal to or greater than 78.0 but equal to or less than 95.0.

5. The golf ball according to claim 1, wherein a thickness of the mid layer is equal to or greater than 0.5 mm but equal to or less than 1.2 mm, and a thickness of the cover is equal to or greater than 0.3 mm but equal to or less than 1.3 mm.

6. The golf ball according to claim 1, wherein a sum (W2+W3) of a weight W2 of the mid layer and a weight W3 of the cover is 8.4 g or greater but equal to or less than 12.0 g, and a sum (V2+V3) of a volume V2 of the mid layer and a volume V3 of the cover is equal to or less than 10 $cm^3$.

7. The golf ball according to claim 1, wherein the specific gravity SG2 of the mid layer is equal to or greater than 1.15.

8. The golf ball according to claim 1, wherein the cover is constituted with resin composition, and the base polymer of the mid layer includes an ionomer resin as a principal component.

9. The golf ball according to claim 1, wherein the JIS-C hardness H(5.0) is equal to or greater than 62.0 but equal to or less than 72.0.

10. The golf ball according to claim 1, wherein the JIS-C hardness H(12.5) is equal to or greater than 63.0 but equal to or less than 73.0.

11. The golf ball according to claim 1, wherein the hardness Shore D H2 is equal to or greater than 35 but equal to or less than 57.

12. The golf ball according to claim 1, wherein the Shore D hardness H3 is equal to or greater than 57 but equal to or less than 66.

13. The golf ball according to claim 1, wherein a difference (H3−H2) between the Shore D hardness H3 and the Shore D hardness H2 is equal to or greater than 4 but equal to or less than 20.

14. The golf ball according to claim 1, wherein an amount of 2-naphthalenethiol is equal to or greater than 0.2 parts by weight but equal to or less than 2.0 parts by weight per 100 parts by weight of the base rubber.

* * * * *